US007703224B2

(12) United States Patent
Karlsson et al.

(10) Patent No.: US 7,703,224 B2
(45) Date of Patent: Apr. 27, 2010

(54) WEARING PARTS SYSTEM FOR DETACHABLE FITTING OF WEARING PARTS FOR THE TOOL OF A CULTIVATING MACHINE

(75) Inventors: Magnus Karlsson, Kristinehamn (SE); Niclas Molin, Kristinehamn (SE)

(73) Assignee: Combi Wear Parts AB, Kristinehamn (SE)

( * ) Notice: Subject to any disclaimer, the term of this patent is extended or adjusted under 35 U.S.C. 154(b) by 167 days.

(21) Appl. No.: 10/540,009

(22) PCT Filed: Dec. 19, 2003

(86) PCT No.: PCT/SE03/02021

§ 371 (c)(1),
(2), (4) Date: Feb. 2, 2006

(87) PCT Pub. No.: WO2004/057117

PCT Pub. Date: Jul. 8, 2004

(65) Prior Publication Data

US 2006/0143953 A1 Jul. 6, 2006

(30) Foreign Application Priority Data

Dec. 23, 2002 (SE) ..... 0203856

(51) Int. Cl.
*E02F 9/28* (2006.01)

(52) U.S. Cl. ..... 37/457; 37/456; 37/455; 37/452

(58) Field of Classification Search ..... 37/446–460; 172/713, 719, 721, 749, 722.5
See application file for complete search history.

(56) References Cited

U.S. PATENT DOCUMENTS 1,188,480 A * 6/1916 Pemberton ..... 37/455

(Continued)

FOREIGN PATENT DOCUMENTS

EP 1174547 1/2002

(Continued)

OTHER PUBLICATIONS

International Search Report, Int'l Appl. No. PCT/SE2003/002021, dated Mar. 17, 2004, 2 pages.

*Primary Examiner*—Thomas A Beach
(74) *Attorney, Agent, or Firm*—Connolly Bove Lodge & Hutz LLP

(57) ABSTRACT

The invention relates to a wearing parts system (1) intended for the tool of a tilling machine of the type which comprises a holder part (3), having a front end part (8), and an exchangeable wearing and/or replacement part (2), arranged over this end part and comprising a hood-shaped (6) hollow (7) which, when the wearing part (2) is fitted in place, is designed to grip over the end part and is fixed thereto by means of at least one locking device (27) placed through interacting openings (28), the end part and the hollow having front, rear and collateral contact zones (9, 22, 23), each comprising contact faces (10, 25, 26), disposed one on the holder part and one on the wearing part, for the absorption of acting vertical, horizontal and collateral forces $F_x$, $F_y$ and $F_z$. The contact faces (25, 26) are designed to interact so as, on the one hand, to limit the pushing-on of the wearing part over the holder part and, on the other hand, to ensure that the contact between the contact faces will be made, primarily, at the common centre $M_0$, of the two radii (of a recess and a projection) essentially in the horizontal plane YZ and secondarily, as the wear has progressed, symmetrically about this mid contact point as an increasingly large contact zone (22', 23').

12 Claims, 16 Drawing Sheets

U.S. PATENT DOCUMENTS

| | | | | | |
|---|---|---|---|---|---|
| 1,330,143 | A | * | 2/1920 | Seal | 37/455 |
| 1,485,434 | A | * | 3/1924 | Seal | 37/455 |
| 1,808,311 | A | * | 6/1931 | Madonna | 37/456 |
| 2,256,488 | A | * | 9/1941 | Murtaugh | 37/455 |
| 2,689,419 | A | * | 9/1954 | Daniels et al. | 37/456 |
| 2,934,842 | A | * | 5/1960 | Van Buskirk | 37/456 |
| 2,990,633 | A | * | 7/1961 | Van Buskirk | 37/455 |
| 3,079,710 | A | * | 3/1963 | Larsen et al. | 37/455 |
| 3,196,956 | A | * | 7/1965 | Ratkowski | 172/713 |
| 3,453,755 | A | * | 7/1969 | Trudeau | 37/456 |
| 3,530,601 | A | * | 9/1970 | Steil | 37/456 |
| 3,774,324 | A | * | 11/1973 | Lafond | 37/457 |
| 3,894,349 | A | * | 7/1975 | Moreau | 37/457 |
| 3,919,792 | A | * | 11/1975 | Hahn et al. | 37/455 |
| 3,982,339 | A | * | 9/1976 | Nilsson | 37/454 |
| 4,231,173 | A | * | 11/1980 | Davis | 37/457 |
| 4,324,057 | A | | 4/1982 | White | |
| 4,335,532 | A | * | 6/1982 | Hahn et al. | 37/459 |
| 4,481,728 | A | * | 11/1984 | Mulder et al. | 37/452 |
| 5,272,824 | A | * | 12/1993 | Cornelius | 37/458 |
| 5,423,138 | A | | 6/1995 | Livesay et al. | |
| 5,561,925 | A | * | 10/1996 | Livesay | 37/455 |
| 5,709,043 | A | * | 1/1998 | Jones et al. | 37/458 |
| 5,806,215 | A | | 9/1998 | Matthews | |
| 5,918,391 | A | * | 7/1999 | Vinas Peya | 37/452 |
| 5,937,550 | A | * | 8/1999 | Emrich | 37/458 |
| 5,987,787 | A | * | 11/1999 | Mack | 37/456 |
| 6,321,471 | B2 | * | 11/2001 | Fernandez Munoz et al. | 37/456 |
| H2020 | H | * | 5/2002 | Kesavan et al. | 37/455 |
| 6,865,828 | B1 | * | 3/2005 | Molino et al. | 37/454 |
| 7,523,572 | B2 | * | 4/2009 | Pasqualini | 37/456 |

FOREIGN PATENT DOCUMENTS

| | | | |
|---|---|---|---|
| EP | 1174547 | A1 | 1/2002 |
| WO | WO-93/20293 | | 10/1993 |
| WO | WO 93/20293 | | 10/1993 |
| WO | WO 95/27102 | | 10/1995 |
| WO | WO-95/27102 | | 10/1995 |

* cited by examiner

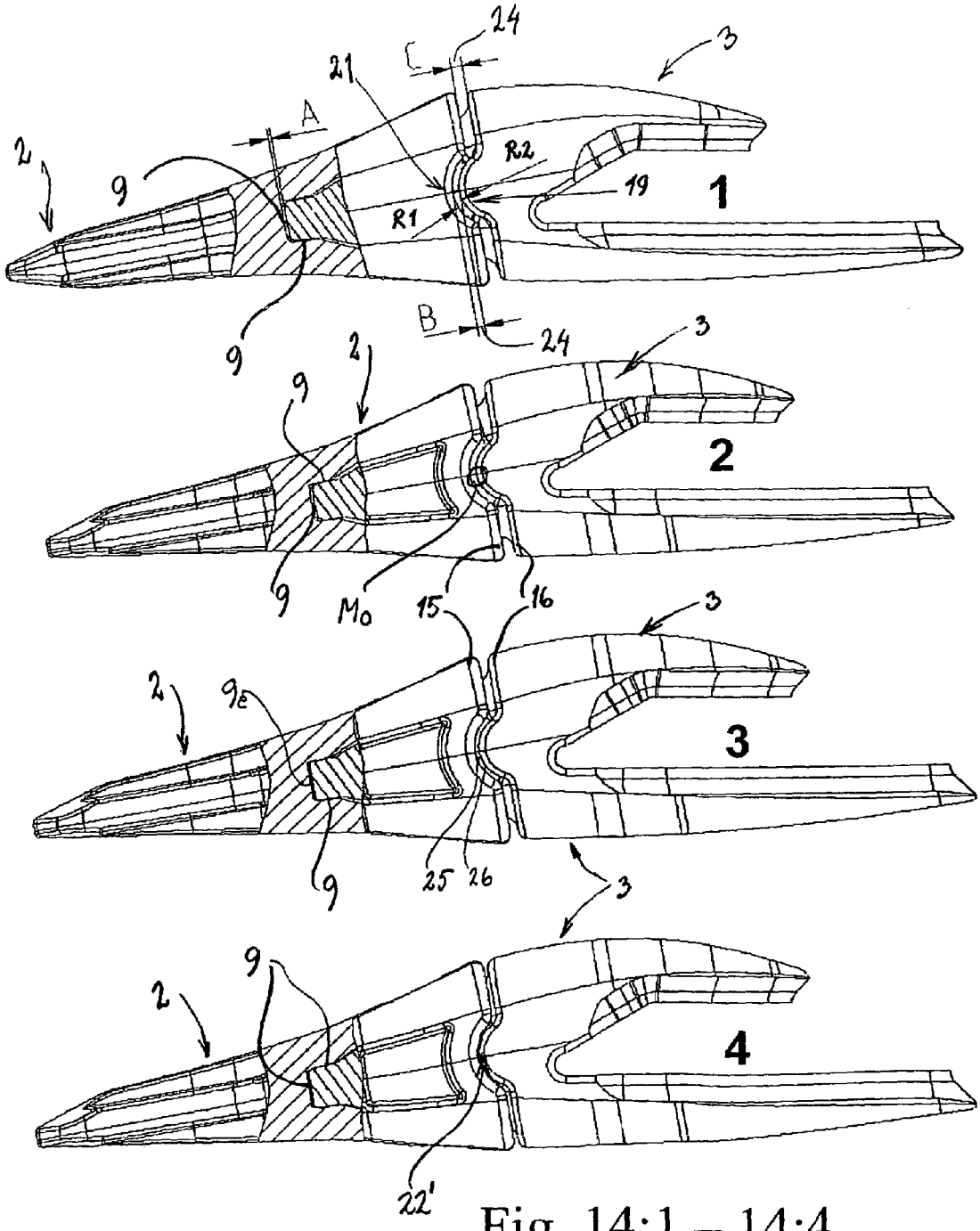
Fig. 14:1 – 14:4

WEARING PARTS SYSTEM FOR DETACHABLE FITTING OF WEARING PARTS FOR THE TOOL OF A CULTIVATING MACHINE

TECHNICAL FIELD

The present invention relates to a wearing parts system intended for the tool of a tilling machine of the type which comprises a holder part, fixedly attached to the tool and comprising an essentially wedge-shaped or beak-shaped front end part projecting in the working direction of the tool, and an exchangeable wearing and/or replacement part, detachably arranged over this holder beak and comprising a rear, essentially hood-shaped hollow, which is matched to the holder beak of the holder part and interacts therewith and which, when the wearing and/or replacement part is fitted in place, is designed to grip over the holder beak and is fixed thereto by means of a detachable locking mechanism comprising at least one locking device, placed through interacting openings made through the holder part and the wearing and/or replacement part, the holder beak and the hollow of the wearing and/or replacement part having, arranged in relation to an essentially cross-vertical plane of symmetry XZ at right angles to the longitudinal line of symmetry Y of the wearing parts system, front, rear and collateral contact zones, each comprising at least two mutually interacting contact faces, certain of which only interact with one another after a certain predetermined wear, which contact faces are disposed one on the holder part and one on the wearing and/or replacement part and are intended to absorb vertical, horizontal and collateral forces $F_x$, $F_y$ and $F_z$ acting in relation to the said line of symmetry Y and a horizontal plane YZ extending along this, of which contact zones: at least one pair of the front contact zones for absorbing the vertical forces $F_x$ is disposed substantially horizontally parallel with and on either side of the line of symmetry Y and the horizontal plane YZ, whilst at least one pair of the rear contact zones forms a certain defined angle with and on either side of the said line Y and plane YZ; at least one pair of each of the front and rear contact zones for absorbing the collateral forces $F_z$ is disposed essentially parallel with one another but laterally offset in pairs and on either side of the line of symmetry Y and essentially vertically in relation to the horizontal plane YZ; and the contact zones designed to absorb the horizontal forces $F_y$ comprise, on the one hand, at least one front contact zone arranged essentially perpendicular to the line of symmetry Y and the horizontal plane YZ, and, on the other hand, at least two rear contact zones, two of which are constituted by interacting and rotary joints, disposed collaterally in vertical arrangement and on either side of the line of symmetry Y and having a common rotational axis Z, which joints each comprise a recess and a projection each comprising a respective contact face, disposed one on each coupling part.

PROBLEMS DEFINITION AND BACKGROUND OF THE INVENTION—COUPLING SYSTEM

At present there are a number of different commercial wearing parts systems for exchangeable wearing and/or replacement parts in connection with tools of a cultivating machine, especially tines on the bucket of an earth-moving machine. Wearing parts systems of this kind usually comprise two main coupling parts in the form of a so-called "female part" and "male part"; on the one hand, a front wearing part in the form of an exchangeable tine point and, on the other hand, a rear stationary holder part which is permanently attached to the bucket. In order to achieve a dynamic, yet still reliable securement of the exchangeable tine point to the holder, the coupling parts also comprise a coupling system which is common to the parts and has a detachable locking mechanism. Each such coupling system has an extremely characteristic geometry in order thereby to try to get the wearing part of the tine to be held in place in an effective, secure and functionally reliable manner, involving only minimal wear, until the wearing part, owing to the, nevertheless, inevitable wear, has to be replaced by a new wearing part.

Coupling systems of this kind can be configured, see, for example, British patent application GB-A-2 151 207 or FIG. 7 in Swedish patent specification SE-B-469 561, such that the one, first coupling part encloses an end part, hereinafter also referred to as a beak, of the opposite, second coupling part—which latter interacts with the first coupling part—around all its outer sides like a hood, from which also the name "hood system". One solution for the coupling system is usually obtained via one or more, in relation to the longitudinal direction of the tine, essentially transverse locking devices, for example a wedge, a slotted pipe, etc., which are introduced through purpose-made locking device openings made through the hood and the beak. These locking devices can be placed centrally through the tine or on one or both sides of the tine. The free outer circumferential edge of the hood, hereinafter referred to as the tine collar, is usually corresponded to by an edge, opposite the tine collar and interacting with the tine collar, disposed on the holder, hereinafter referred to as the beak collar.

Known commercial hood systems of this kind are very often configured to absorb loads (F) which act parallel or approximately parallel with the line of symmetry of the coupling geometry in the Y-direction toward the cutting edge of the tine point, i.e. essentially along a plane extending in the longitudinal direction of the tine, see FIG. 1, via one or more, specially configured and mutually interacting contact zones, which are disposed at a certain angle to the said line of symmetry and plane, hereinafter referred to as the longitudinal axis, and horizontal plane or YZ-plane. Each such contact zone comprises at least two mutually opposite and interacting contact faces, at least one of which is disposed in the first coupling part, whilst the second is disposed in the second coupling part. When these contact faces are placed substantially perpendicular to the said longitudinal line of symmetry Y, i.e. essentially in the cross-vertical plane (XZ), further threading is stopped dead by the tooth on the holder, so that these surfaces are also hereinafter referred to as stop faces. Another way is to arrange the contact faces at a certain inclination to the different planes, whereby the load is absorbed by the friction forces which are attained owing to the wedging effect between the surfaces.

It will be appreciated, however, that, in the use of the tool, not only are loads formed which are parallel with the longitudinal plane of symmetry, in the Y-direction, of the coupling geometry, but also loads which deviate from the Y-direction. Essentially each load (F) therefore comprises an axial force component $F_y$, which is formed parallel with the longitudinal direction of symmetry Y of the coupling geometry and acts perpendicularly to a cross-vertical plane in the X-direction, hereinafter also referred to as the XZ-plane, on the one hand a lateral transverse force component in the Z-direction, $F_z$, which acts perpendicularly to the longitudinal vertical plane of the coupling geometry, hereinafter referred to as the side plane or the XY-plane, and, on the other hand, a further transverse force component $F_x$, which acts in the X-direction perpendicularly to the YZ-plane of the coupling geometry, i.e. the said horizontal plane.

The designations which are used below, such as vertical faces, side faces, horizontal faces, etc. can consequently be derived from the above-stated definitions for the said forces and planes.

Those loads against the tine point which give rise to transverse forces, i.e. the two latter transverse component forces $F_x$ and $F_z$, are partially absorbed by means of similar contact zones comprising vertical and lateral contact faces arranged at different angles to the directions of action.

The component forces $F_x$, $F_y$ and $F_z$ can also, as a result of their leverage ratio, give rise to troublesome torque loads, which have to be absorbed via double contact zones disposed on either side of the axis about which the rotation occurs. Each of these contact zones consists, in the same way as previously, of at least two interacting contact faces. For example, the torque load which is caused by the transverse component force $F_x$ is absorbed via at least one front and one rear contact zone relative to the Y-direction, which contact zones expediently are disposed essentially parallel with the Y-line of symmetry on either side of the locking device and on their respective opposite coupling part.

For example, in the coupling systems which are known by virtue of the said specifications SE-B-469 561 and GB-A-2 151 207, the holder part and the tine part respectively comprise, viewed in a vertical longitudinal section (XY), V-shaped concave and convex stop faces respectively, tapered toward the tine cutting edge, which stop faces mutually interact and absorb the axial forces $F_y$, but also absorb torque loads caused by vertical forces $F_x$ about the Z-axis. Longitudinal ridges with corresponding grooves are provided in order to absorb the lateral forces $F_z$. Over and above this, the collars of the holder part and tine part comprise V-shaped and rectangular protections and recesses respectively, which are complementary to each other and which also, for their part, act as stop faces, i.e. they are in contact with each other along their vertical end faces after the coupling parts have been brought together into their common end position. These projections and recesses respectively are herein meant to eliminate the mobility between the holder part and the tine part which is a consequence of inevitable production tolerances, but they will also absorb torque loads, which can lead to the emergence of undesirable leverage ratios after a certain period of asymmetrical wear.

During operation, in fact, all the integral contact faces, inclusive of the stop faces, will be sheared, worn and deformed to a varying extent during irregular dynamic motion between wearing part, holder part and locking device. Moreover, both the tine part and the holder part will suffer essentially equal wear, with the result that both of them have to be replaced once the wear has reached its maximum level. This is very costly, of course, and since each holder part, moreover, is welded to the bucket, the down time is far longer than with a rapid replacement of just the wearing part.

It is therefore desirable to achieve a coupling system which allows essentially only the wearing part to be subjected to serious wear and tear, whilst the holder part and the locking device are substantially excluded from at least external wear, and in which inevitable wear between the contact faces of the parts, as far as possible, only occurs in respect of predetermined and specially purpose-made surfaces.

A further and very serious problem with the abovementioned coupling systems is that the locking device risks being cut off by the shearing forces which are generated, on the one hand, when the tine part and the holder part are displaced horizontally toward each other owing to continuous wearing down of the angled stop faces and of the stop faces on the collars, and, on the other hand, when the coupling system is subjected to unfavourable rotational loads about an unforeseen contact, newly arisen because of the wear, between the collars of the wearing parts system. In order to avoid this happening, a stop zone is provided which has a butting effect right from the point of coupling, by which arrangement the vertical end faces of the two collar parts, at least initially, are not in mutual contact. An example of this is shown in American patent specification U.S. Pat. No. 2,689,419, in which a front, essentially vertical stop face has been disposed at the front edge of the holder beak for interaction with a corresponding inner stop face inside the hollow of the wearing part.

As the wear increases on the original vertical stop faces designed for wear, a second and undesirable secondary contact zone will form, however, between the rear edge of the tine collar of the wearing part and the front edge of the collar of the holder, i.e. a secondary stop zone is formed around the tine collar and the holder collar in the vertical plane XZ of the respective collar, which edges/vertical planes do not initially meet and which secondary stop zone, moreover, will gradually grow.

If the tine is now subjected to a transverse force, $F_x$ and $F_z$, acting toward the line of symmetry Y of the coupling geometry, at the tine point, the rotary motions in the coupling system will increasingly depend on the positions of the secondary, unfavourable stop faces. The new stop faces on the collar, in combination with the locking device, therefore replace the previous front and rear horizontal contact faces and the corresponding front and rear vertical side contact faces along essentially the YZ and XY-plane respectively, which contact faces were intended to lift the transverse forces $F_x$ and $F_z$ respectively which were so unfavourable to the locking mechanism. A torque leverage which is very detrimental to the strength will in this case be obtained for the majority of load cases, which leverage will give rise to the shearing forces which will cut off the locking device.

In the coupling system according to U.S. Pat. No. 2,689,419, the locking wedge is at its weakest at the tapered end of the locking wedge, precisely where the said shearing forces are likely to be greatest, i.e. on the friction surfaces between the wearing part and the holder part, both owing to the leverage ratios of the said loads and owing to the fact that the play between the collars is equally great all the way round, with the result that the undesirable secondary contact zone will very easily be formed such that the leverage ratio is obtained which is most unfavourable to the construction.

Further, when an extensive wear has occurred on the contact and stop faces, the remaining material between the locking device openings in the hood and the rear edge of the wearing part, and the material between the horizontal friction surfaces of the holder beak and the locking device opening through the beak will have been weakened so much that cracks are formed, after which the coupling is broken apart. In order to try to avoid this process, the thickness of the material on the sides of the wearing part and around its locking device opening has been increased in the Z-direction, at the same time as the tine collar of the wearing part has acquired a reinforcement in the form of a projection rearward toward the holder part, so that the actual locking device opening has been able to be moved rearward. The material thickness of the beak has also thereby increased at the level of its locking device opening. This solution adds to the cost and complexity of production, at the same time as the increased material thickness of the beak also means a higher profile of the tine in the portion over the beak, which is unfortunate from the penetration aspect. Moreover, the so-called exchange will be worse owing to the material which has necessarily been applied rearward to the wearing part of the known tine. To obtain as large an exchange as possible is fundamental to the design of a new tine. In order to create an optimal tine, the part which is left when the tine is worn out should be as light as possible in terms of weight. Since the price of wearing parts can often be approximated in Kr./kg. and since the overwhelming part of the wear occurs on the tine point, i.e. that part of the wearing part which is in front of the inner hollow, a tine should have the smallest possible share of its weight behind the tine point defined according to the above.

Further essential objects of the present invention are therefore to prevent the described secondary contact zone between the tine and holder collars from being able to be formed by chance and at least substantially to reduce the risk of the secondary contact zone being able to give rise to shearing forces which are unfavourable to the locking mechanism.

Because of the tapered shape of the holder beak in the direction of the front edge, previously known coupling systems have shown a tendency to allow the tine part to move forward when vertical load is applied to the tine point, i.e. to allow the tine part to slide off along the holder part performing a ski jump, thereby subjecting the locking device to undesirable stress. It is therefore a requirement that a wearing parts system construction shall be attainable which eliminates or at least minimizes this tendency.

Locking Mechanism—General:

Present-day locking devices are essentially constituted by two different types, on the one hand, solid and, on the other hand, elastically working locking devices.

The solid locking devices have a rigid lock body, which, for example, can be straight, such as bar-shaped, or more wedge-shaped. The elastic locking devices usually comprise a somewhat elastic element, for example a spring or an elastomer, which is compressed in connection with each fitting and removal of the locking device, by which element the tine part is forced up onto the holder part by the force created by a pretensioning of the elastic element, at the same time as the locking device is prevented from moving out of its position. Locking devices can also be classified according to how the locking mechanism is placed, i.e. the extent to which the locking device is intended to be fitted vertically or horizontally in relation to the coupling geometry of the tine. For both types there are both advantages and disadvantages, but since today's customers often choose the vertical locking devices because of their greater user-friendliness, i.e. much simpler fitting and removal, and, to a certain extent, because the vertical locking devices enable the tine to be given a lower profile with accompanying higher penetrativeness, it remains to try to reduce or eliminate the disadvantages of the vertical locking devices. These disadvantages are constituted, above all, by the risk that the locking device, when dynamic vertical load is applied to the tine point, will "work itself out" of the locking device opening such that the tine point falls off, and by the fact that the said dynamic vertical loads subject the locking mechanism to much more serious shearing forces in the case of vertical placement than in the case of a horizontal placement.

Three-Section Locking Mechanism:

Known locking devices have normally to be removed by means of powerful hammer blows, which means that the more solid types quickly become unusable owing to the wear and the deformation which occurs on the lock body and along the locking device opening. The wedge-shaped type, though simple to fit and remove, also has a greater tendency to come loose owing to the vibrations and dynamic stresses which are generated during normal operation.

In the case of elastic locking devices, the said pretensioning will accelerate the ageing of the elastic element and thereby reduce the maximum working life of the locking mechanism. When the rubber or the spring ages, the pretensioning required for the locking device to remain seated in the opening despite the said problems with vibrations, unfavourable tolerance levels, wear and other stresses on the contact faces, etc., all of which adversely affect the horizontal motions of the wearing part on the holder part, will in fact steadily decrease until the locking device, quite simply, can fall out by itself. In order for the locking mechanism always to have contact with tine and holder and thereby pretension the tine up onto the holder, a relatively long pretensioning distance is required, i.e. the distance by which the elastic element is compressed and expanded. The elastic element must also be able to perform a large number of changing compression cycles over a long period without the locking element being prone to overcompression, yet must still be able to maintain its functioning essentially as before, thereby raising the quality requirements and hence the price. Overcompression is often what first limits the working life of the locking mechanism, with the result that the dimensions for the elastomers are often increased in order thereby to compensate for the overcompression problems.

One requirement is therefore to be able to produce a locking mechanism which preferably never needs to be compressed more than the compression which is required in order to achieve the pretensioning necessary to the operation or which essentially only needs to be compressed a little further in connection with the actual fitting and removal of the locking device. A further requirement is for the locking device to be able to be introduced to approximately half its length before a hammer-fitting becomes necessary. This yields the advantage that the locking device does not need to be stabilized manually as it is actually being hammered down.

A solution to the above-stated problems which has previously been adopted in connection with elastic locking devices has been for the locking device and the receiving locking device opening to have been configured such that the various plates of the locking device, i.e. the movable engagement part(s) which is/are fixed to or controlled by the elastic element, after an initial extra compression of the element during the actual introduction of the locking device through the locking device opening in the hood, reach an extra inner cavity inside the locking device opening through the beak, which cavity is somewhat more spacious than the actual hole through the hood. The engagement parts of the locking device can now be inserted into this cavity via a slight expansion of the elastic element. In this case, a locking device situated in the cavity does not, therefore, always need to be as pretensioned as in the actual initial introduction in order to achieve a necessary locking. However, elastic locking devices of this kind, introduced into an inner cavity, are difficult to remove, since the compression which is necessary for the removal of the locking device becomes more difficult to achieve. The above-stated method of attempting to remove the locking device by hammer blows often results, if a spring is used, in the said spring being broken off. If a body which is elastic in all directions is used, a rebound is instead obtained, which is caused by the elastic element not being able to expand in another direction upon impact, with the result that the compression and the expansion occur in substantially the same direction as the hammer blows.

Notch for Locking Mechanism:

A known solution is to use an elastic rubber core which is thinner in the middle so as to compensate for the expansion of the rubber when compressed or to make the cross section of the locking device opening somewhat larger than that of the locking device, i.e. to provide extra spaces which are kept empty purely for the expansion of the rubber to allow removal of the locking device, works only if these spaces are not filled with dirt, "Dirt", i.e. snow, clay, soil, etc. will, in fact, quickly penetrate into and fill this extra space. Should "the dirt", moreover, dry or freeze into a compact body, the replacement of tines is made yet more difficult.

These locking devices, too, are therefore very difficult to undo after a certain period of use. Should the extra space along the hole be made sufficiently large or continuous to allow removal of the dirt from the outside, then the disadvantage is instead obtained that the strength of the tine naturally declines when the thickness of the material decreases, without an actual solution to the dirt-sticking problem.

It is therefore a high requirement to be able to produce a considerably improved locking device which has the advantages of the simple fitting and removal of the wedge shape, the advantageous springing of the elastic locking device, without its pretensioning leading to premature ageing of the rubber, and the characteristic that "dirt" shall not be able to accumulate or, at least, shall not be able to prevent the elastic part of the locking device from expanding sufficiently for the locking device to be easily detachable, even out of an inner, empty cavity intended for the locking device.

The Pin and the Shearing Zone Relocation:

In the sliding zone between the tine part and the holder part, see, for example, U.S. Pat. No. 2,689,419, the details 58, 59 in FIG. 15, a shearing force critical to the durability of the locking device is generated, which is caused by horizontal motions between the coupling parts. The said sliding zone has, moreover, the worst leverage ratio of all hood-type wearing parts systems, i.e. the longest leverage from the Y-line of symmetry, with the result that the shearing forces caused by occurring torque loads are most intensive in this section. These shearing forces risk cutting off the locking device, with the result that an unbroken cross section through only the homogeneous part of the lock body is desirable. In the cross section in which the lock body is weakened by a hollow for an elastomer, no or minimal shearing forces should therefore be generated. At the same time, with this type of locking device, the securing plate of the locking device should be disposed no higher than level with the inner side of the tine part inside the hood, i.e. "the hood roof", in order to be able to secure the locking device in its position, whereby the position of the top edge of the said hollow for the elastomer is also essentially determined. Having the locking device carry out the securement in the holder part instead of against the hood roof leads to undesirable loads being transferred via the locking device to the holder part. The optimal load case is, in fact, that in which all dynamic loads are transferred directly from the tine part to the holder part and never via the locking device. The optimal use of the locking device is solely to prevent the wearing part from falling off when the tool is lifted from the ground surface and to hold the special contact faces of the coupling parts in mutual contact without play. Further, a placement of the securing plate against the hood roof leads instead to the elastomer hollow coming so "high up" that the said unbroken cross section cannot be obtained. Yet another requirement is therefore to produce a locking device which resolves this conflict of interests.

PURPOSE OF THE INVENTION AND ITS DISTINCTIVE FEATURES

A main object of the present invention is therefore to produce an improved wearing parts system for fitting exchangeable wearing parts on the tool of a cultivating machine, which wearing parts system eliminates or at least substantially reduces all or most of the problems described above.

A further main object of the present invention is to produce a substantially improved locking mechanism for the said wearing parts system, in which the favourable effects of the different lock types can be utilized simultaneously and in a better way than previously.

The said object, and other purposes which have not here been listed, are achieved within the scope of that which is stated in the present independent patent claims. Embodiments of the invention are set out in the independent patent claims.

Thus, according to the present invention, an improved wearing parts system for fitting exchangeable wearing and/or replacement parts on a tilling machine has been produced, which is characterized in that the common rotational axis Z is disposed essentially in the horizontal plane YZ and essentially perpendicular to the direction of fitting of the locking device, in that the said recesses are made on the wearing and/or replacement part and facing concavely forward in the longitudinal direction of the latter, preferably comprising a respective end face of radius $R_1$, essentially radially arched about the Z-axis, in that the projections are disposed on the holder part and facing convexly forward in the common longitudinal direction of the coupling parts, preferably comprising a respective end face of radius $R_2$, essentially radially arched about the Z-axis, which collateral contact faces preferably have different radii $R_1$, $R_2$, and which contact faces are designed to interact so as, on the one hand, to limit the pushing-on of the wearing and/or replacement part over the holder part and, on the other hand, to ensure that the contact between the collateral contact faces primarily will be made at the common centre $M_0$ of the two radii $R_1$, $R_2$ essentially in the horizontal plane YZ and secondarily, as the wear has progressed, symmetrically about this mid contact point $M_0$ as an increasingly large contact zone.

According to further aspects of an improved wearing parts system according to the invention:

the locking device vertically arranged in the interacting openings between the wearing and/or replacement part and the holder part, and the openings in the wearing and/or replacement part and the holder part, are divided into at least three different sections in the longitudinal direction of the interacting openings, in which the section, through the one wall of the hood, of the locking device opening which appears first in the direction of fitting of the locking device, which wall limits the hollow of the wearing and/or replacement part on a first side, has the widest cross section, whilst the third section, through the second wall of the hood, opposite the first wall, of the locking device opening which appears last in the direction of fitting of the locking device has the smallest cross-sectional section and the first introduced, third section of the locking device, which is intended, following completed fitting, to extend through and precisely fit the section, in the second wall of the hood, of the third locking device opening has the smallest cross-sectional section, whilst the second locking device section in the direction of fitting, which extends through the section, through the beak of the holder part, of the second locking device opening has a somewhat larger cross section than the first introduced, third section of the locking device, but, at the same time, somewhat smaller than the section of the said second locking device opening, with the result that this locking device opening through the holder beak contains a remaining, empty cavity even after the fitting of the locking device, and the last introduced, first section of the locking device has the widest cross section of the locking device, which corresponds to and fits the section, through the first wall of the hood, of the first locking device opening, the locking device is of the type which comprises a rigid locking device body having an elastically deformable resilient material inlaid into the locking device body, which material loads at least one movable engagement part toward a predetermined position, the locking device comprises at least two movable engagement parts loaded by elastically deformable resilient material, which engagement parts are constituted by a securing plate for detachable blocking of the locking device in a predetermined locking position, and a compression plate, which, via its elastically deformable resilient material, is designed to load the contact zones of the wearing and/or replacement part and of the holder part one against the other, the locking device comprises an inner hollow for the elastically deformable resilient material, which hollow has a first gap opening on its one side, intended for the expansion of the elastically deformable resilient material outside the body of the locking device when this is subjected to load during the removal of the locking device, and, in addition thereto, one or more further gap openings through which the particular engagement parts, in a state which for the locking device is free from external loads, project a certain way beyond the body of the locking device, the locking device opening through the beak of the holder part comprises a first portion in the direction of fitting which is at least wider in a first direction, preferably essentially in the Y-direction, and preferably also broader in a further direction, in this case essentially in the Z-direction, than a corresponding portion of the body of the fitted locking device, which portion of the locking device opening comprises a first segment and a second segment, which first segment, which is wider than the corresponding locking device body in the said first direction, is designed to constitute a cavity intended for the securing plate in its extended position blocking the locking device, whilst the second segment of the said first portion of the locking device opening through the beak of the holder part is broader in the said second direction than the rest of the section(s) of the locking device body which come next in the direction of removal and is preferably configured as an angular bevel having its largest cross-sectional opening coming first in the direction of fitting of the locking device, which second segment, together with the body of the fitted locking device, is designed to constitute, or form, a space intended for the expansion of the elastically deformable resilient material when this is subjected to load during the removal of the locking device, connecting to the locking device opening through the hood of the tine part there is a transverse pin which projects with a certain defined length inward in the direction of fitting of the locking device and is disposed on the inner side of the roof of the hood, against which pin the securing plate of the locking device shall fix in order to produce a downward shift of the securing plate in the direction of fitting of the locking device and hence a greater material thickness at the corresponding end of the locking device body, since the locking device body openings and the cavity through and in which the securing plate acts is disposed within the sliding zone between the tine part and the holder part in the direction of fitting of the locking device, a bevel, which widens downward in the direction of fitting of the locking device, is disposed on that side of the locking device body facing toward the said pin, so that the locking device body and the pin are free from contact with each other, a cross section through the body of the fitted locking device level with the inner side of the roof of the hood consists of a homogeneous, solid, unbroken cross section or a cross section which is unbroken to the extent of at least 50% or more, the leverage ratio from the Y-line of symmetry to the contact point $M_0$ between the hood of the tine part and the holder part is equal to zero or less than the radius $R_2$ of the projection, the distance between the end faces of the collateral joints at their common centre $M_0$ disposed essentially in the horizontal plane YZ is equal to zero or substantially less than between the end faces of the collars in order to ensure that the secondary contact zones which are increasing at each of the joints, as increasing wear has occurred between the wearing and/or replacement part and the holder part, have a symmetrical position about the said common centre $M_0$, the radius $R_1$ for a respective recess is preferably somewhat larger than the radius $R_2$ for a corresponding projection, the effect of which is that the spacing, i.e. the play, varies depending on which radii are chosen and that the contact between these curved end faces will be made, primarily, at the common centre of the various radii $R_1$, $R_2$ in the horizontal plane, so as then, after a certain defined wear, to grow symmetrically into a radial contact zone about this mid contact point $M_0$ as the wear progresses, at least two rear contact zones, symmetrical in relation to the Y-symmetry axis, are provided, which comprise a greater angle of inclination to the Y-line of symmetry of an inner, longitudinal peripheral line $P_i$ along the locking device opening through the beak than of an outer, collateral longitudinal peripheral line $P_{ii}$, the various contact faces comprise a plurality of different, symmetrically arranged inclinations, conicities and roundings in relation to the horizontal plane YZ, the side plane XY and the vertical plane XZ, several being parallel but laterally offset with a view to achieving a very exact guidance when fitting and removing the parts, so that the ready-fitted wearing parts system becomes virtually free from play and free from seizure, the torque loads caused by the rotation of the wearing and/or replacement part in relation to the holder part are designed to be absorbed directly or after a certain minor wear by at least one of the front contact zones in interaction with at least the said contact zones on the rear collateral joints.

ADVANTAGES AND EFFECTS OF THE INVENTION

Coupling System

The aforementioned tendencies of the tine to slide down from the holder nose are combated effectively by imitation of the so-called drawer effect, i.e. the particular contact faces between the holder part and the tine part will jam and thereby "hold together" the parts one in relation to the other.

One embodiment having a greater angle of inclination to the Y-line of symmetry of the inner, longitudinal peripheral line $P_i$ along the locking device opening of the two symmetrical rear, essentially horizontal contact zones offers a further advantage. This greater angle makes it possible, through a displacement of the tine part up on to the holder part in the Y-direction, to absorb production tolerances with a minimized play between tine and holder, which yields good stability and thereby reduced wear. A poor fit and an unreliable locking device therefore increases the risk of tine fracture or lost tines.

The "drawer effect" as described above, the different inclination, conicity and rounding of the various contact faces in relation to the above-defined horizontal plane, side plane and vertical plane, and the special design of the locking device, means that a very exact guidance is obtained when fitting and removing the parts and that the ready-fitted tine is virtually free of play.

The locking device is not normally subjected to any actual compressive loads, but has essentially only a detaining function whilst the tine is lifted in the direction up from the surface which is being tilled.

Side Radius, Secondary Stop Face:

The predetermined contact zone between the respective collars at the end faces of the collars, whilst the rest of the tine and holder collars are normally kept apart, substantially reduces the risk of occurrence of unfavourable leverage ratios.

Three-Section Locking Mechanism:

According to the present invention, the desired advantages are achieved that the locking device can be introduced to about half its length before it comes round to the projecting plates or the larger cross-sectional sections, necessitating a hammer, that the locking device does not need to be held manually during the last driving down part of the introduction and that the fitting and removal of the locking device, especially where tines are placed relatively close together, is made substantially easier in the case of the vertically placed locking device than compared with, for example, the horizontally placed locking device for use with the abovementioned tine in U.S. Pat. No. 2,689,419.

A further advantage which is achieved is that the elastic element does not need to be compressed to a significantly greater extent during the actual fitting and removal than compared with the compression which the elastic element has once the system is ready for operation. The element does not need to be overcompressed in order to obtain a sufficiently large pretensioning distance and the whole of the motional path of the elastic element in the operative position can therefore be utilized.

Notch for Locking Mechanism:

As regards the abovementioned dirt problem, the present invention, in a further embodiment, has solved this by constructing the locking mechanism, including in the Z-direction, see FIGS. 1, 10, 11 and 15, in different-sized cross-sectional sections, with the largest uppermost, and since a special angular bevel has been made in the locking device opening through the beak part, see FIG. 15*b*, a removal of the locking device will result in the creation of an empty space for the smaller dimension(s) via the difference in size of the cross sections. The effect of this is that the expanding part of the rubber, caused by the pressing-in of the plates, can now be moved out into the empty space thereby created. The removal of the locking device is therefore essentially independent of all dirt penetration.

A further advantage is that, since the cross section of the lock body and of the locking device opening is extremely asymmetrical in both the Y and the Z direction (according to FIG. 1), the fitter will not need to consider how the locking device should be facing in the application.

The Pin and the Shearing Zone Relocation:

According to the present invention and its embodiments, the advantage is obtained that a downward shift of the plates of the locking mechanism is enabled, so that the inner cavity into which the plates reach is herewith shifted out of the direct shearing zone between the tine part and the holder part. The shearing loads will herewith be absorbed by a virtually homogeneous cross section through the solid lock body of the locking device. In order further to increase the strength of the locking device, the gap opening in the lock body for the expansion of the elastomer is made only on the one side face of the lock body, see FIG. 13.

Contact faces which expressly are intended to act as wearing surfaces are found only between the tine part and the locking device body, not between the holder part and the locking device. The contact between the compression plate and the holder part serves only to give necessary support for producing the said pretensioning of the tine part up onto the holder and for achieving less play. None of the plates of the construction is actually intended to absorb any dynamic load caused by the use of the tool, whereby the functioning and working life of the system is substantially improved. The holder part therefore suffers minimal wear on all surfaces which are not specially designed for the purpose, for example the stop face at the very front of the beak, with the result that the holder part can be reused many times before needing to be replaced.

LIST OF FIGURES

The invention will be described in greater detail below with reference to the appended figures, in which:

FIG. 1 is a schematic exploded diagram in perspective view of parts of a wearing parts system, according to the present invention, for wearing or exchangeable parts for fitting to the tool of a cultivating machine, the coupling parts of which wearing parts system comprise a front wearing part in the form of an exchangeable tine point, a rear holder part for fastening to the particular tool, and, for the said parts, a coupling system having a common locking mechanism via a locking device, all shown with coordinate axes so as to illustrate the coupling geometry.

Figure 1:
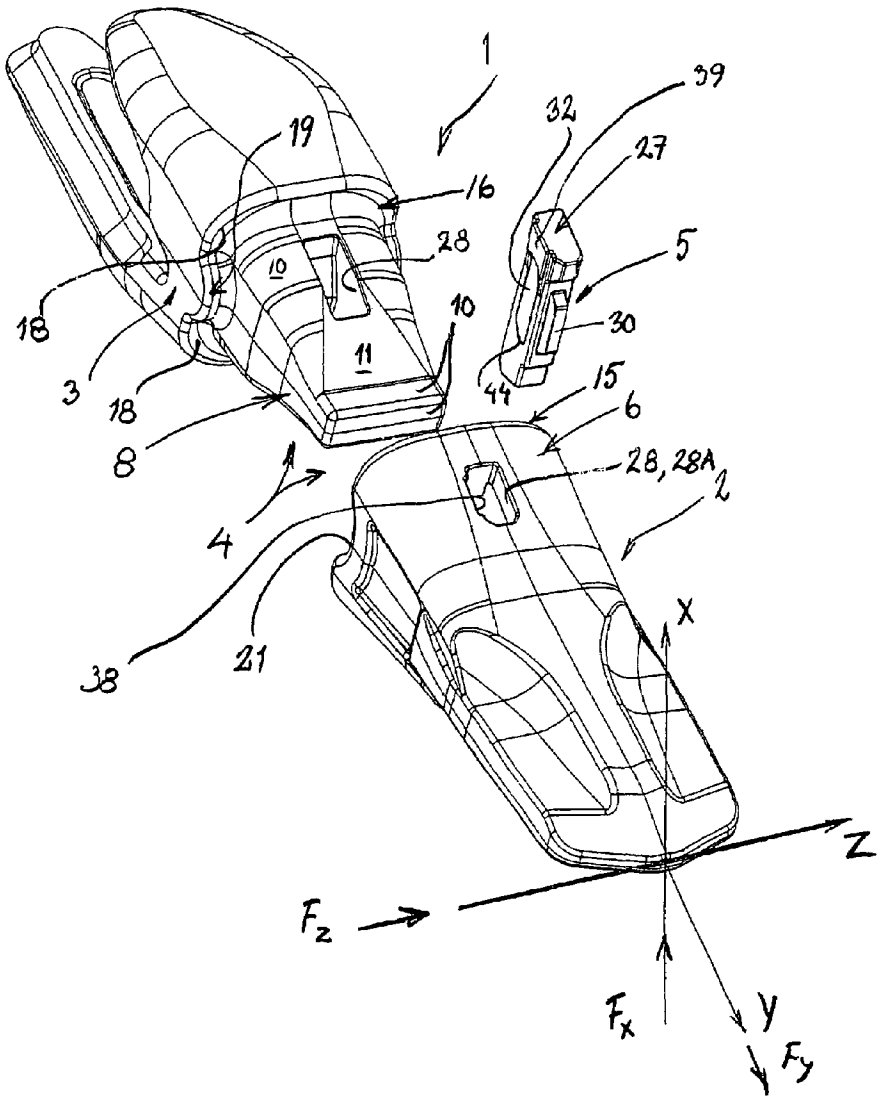
Figure 4A:
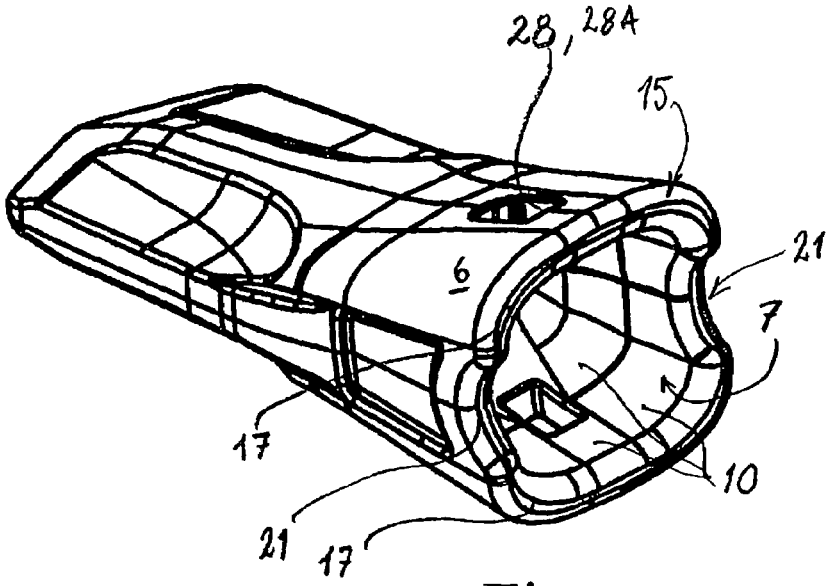

FIG. 4*a* is a schematic perspective view of parts of the wearing part according to FIG. 1, viewed from above and obliquely from the rear.

Figure 4B:
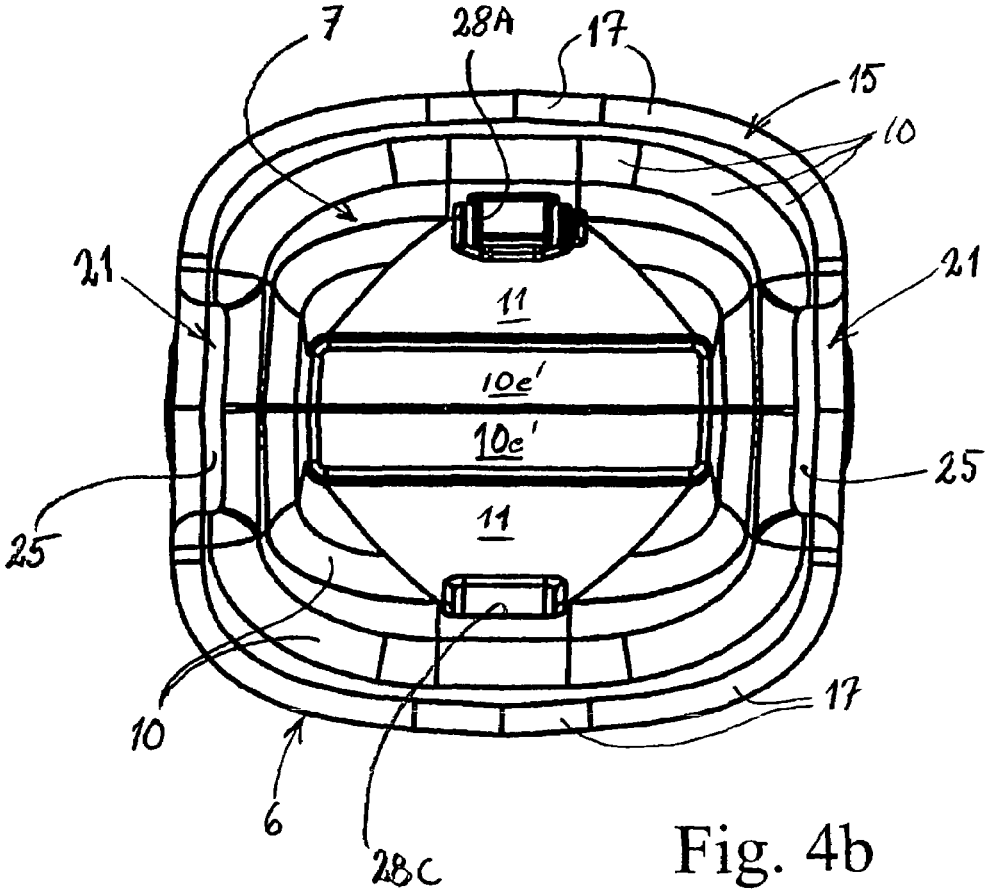

FIG. 4*b* is a schematic end view of parts of the wearing part according to FIG. 1, viewed from the rear.

Figure 5:
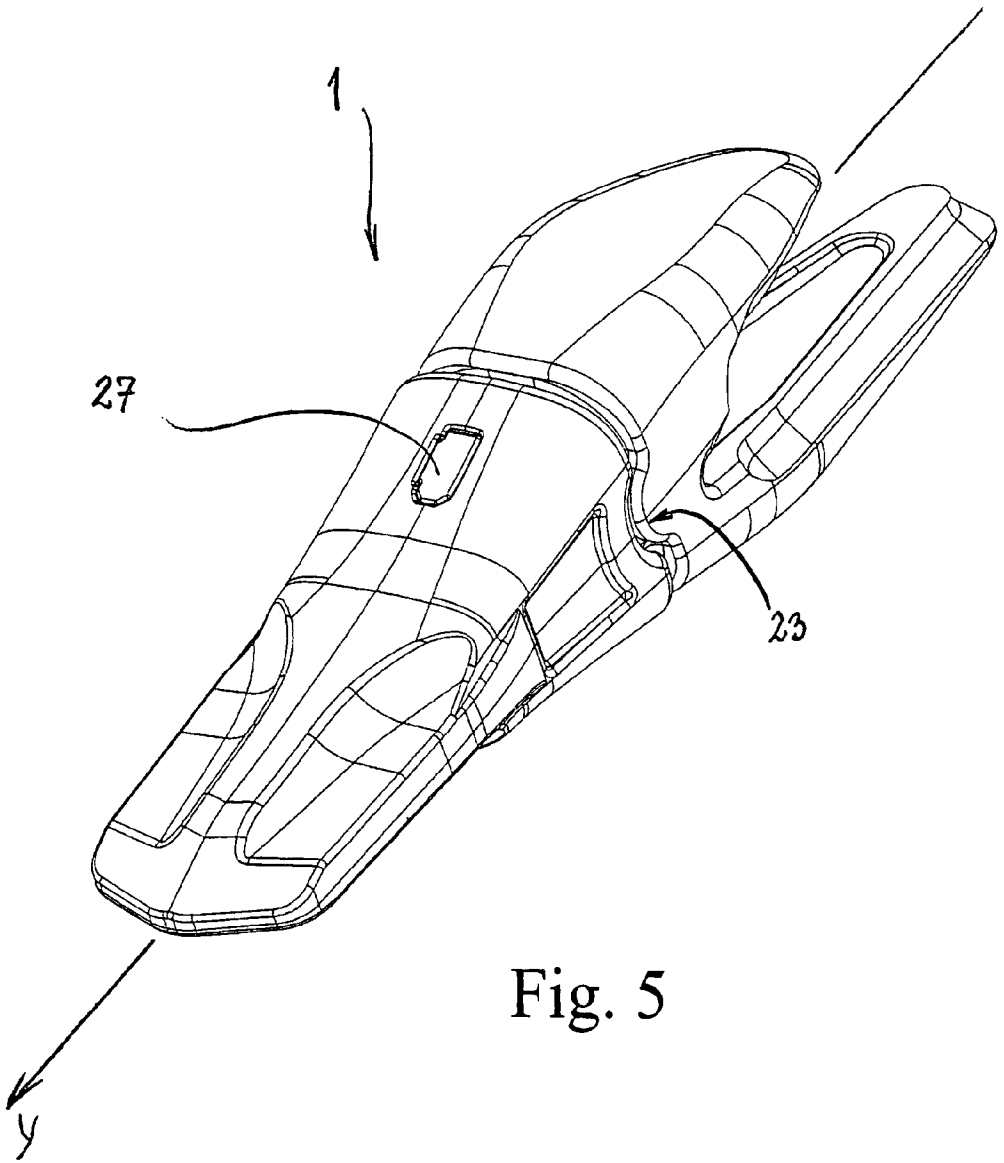

FIG. 5 is a schematic perspective view of parts of the coupling parts forming part of the wearing parts system and put together to form a tilling device in the form of a tine according to FIG. 1, viewed from above and obliquely from the front.

Figure 6:
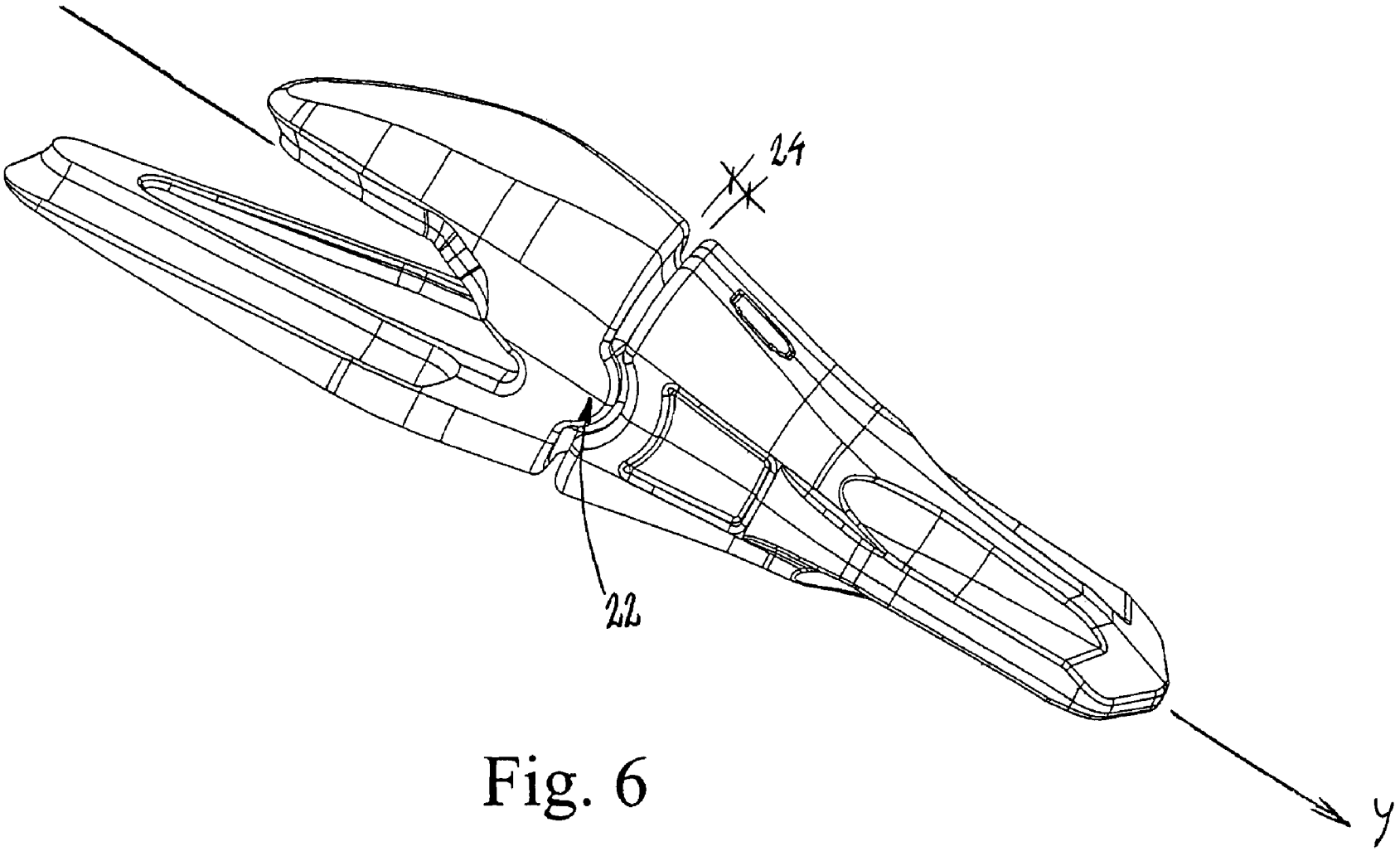

FIG. 6 is a schematic perspective view of the assembled coupling parts according to FIG. 5, viewed obliquely from the side.

Figure 7:
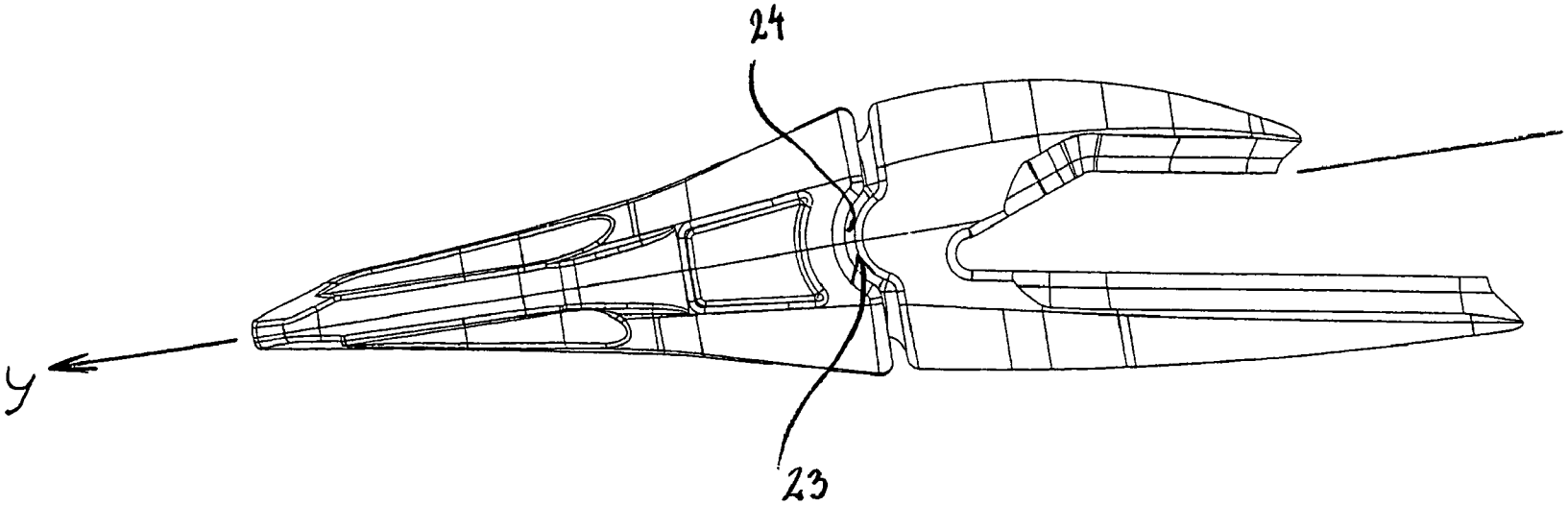

FIG. 7 is a schematic side view of the assembled coupling parts according to FIG. 5, viewed from the side, especially showing the initial play between the collars of the wearing and holder part respectively, and a preferred position for a common side joint disposed on either side of the coupling parts and between the collars, which side joint comprises a projection and a recess interacting with this projection and has two end faces of different radii disposed directly opposite each other and arranged radially about the Z-axis.

Figure 8:
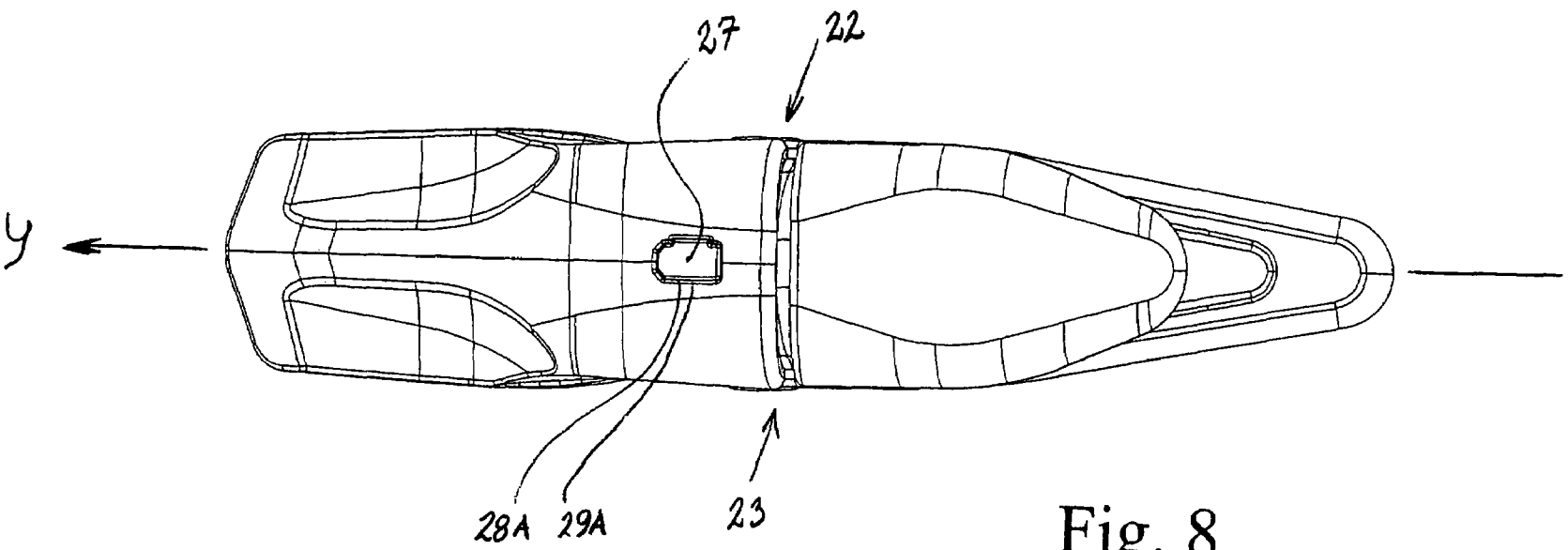

FIG. 8 is a schematic top view of parts of the assembled coupling parts according to FIG. 1, viewed from above.

Figure 9:
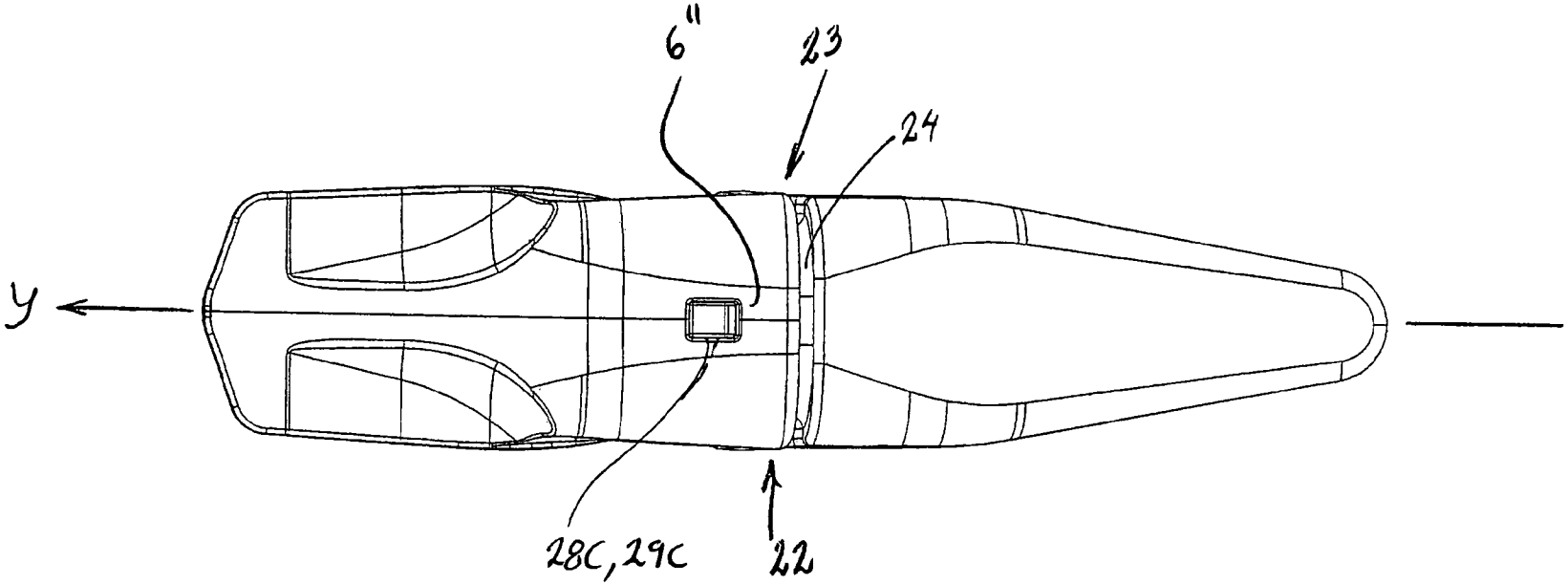

FIG. 9 is a schematic bottom view of parts of the assembled coupling parts according to FIG. 1, viewed from below.

Figure 10:
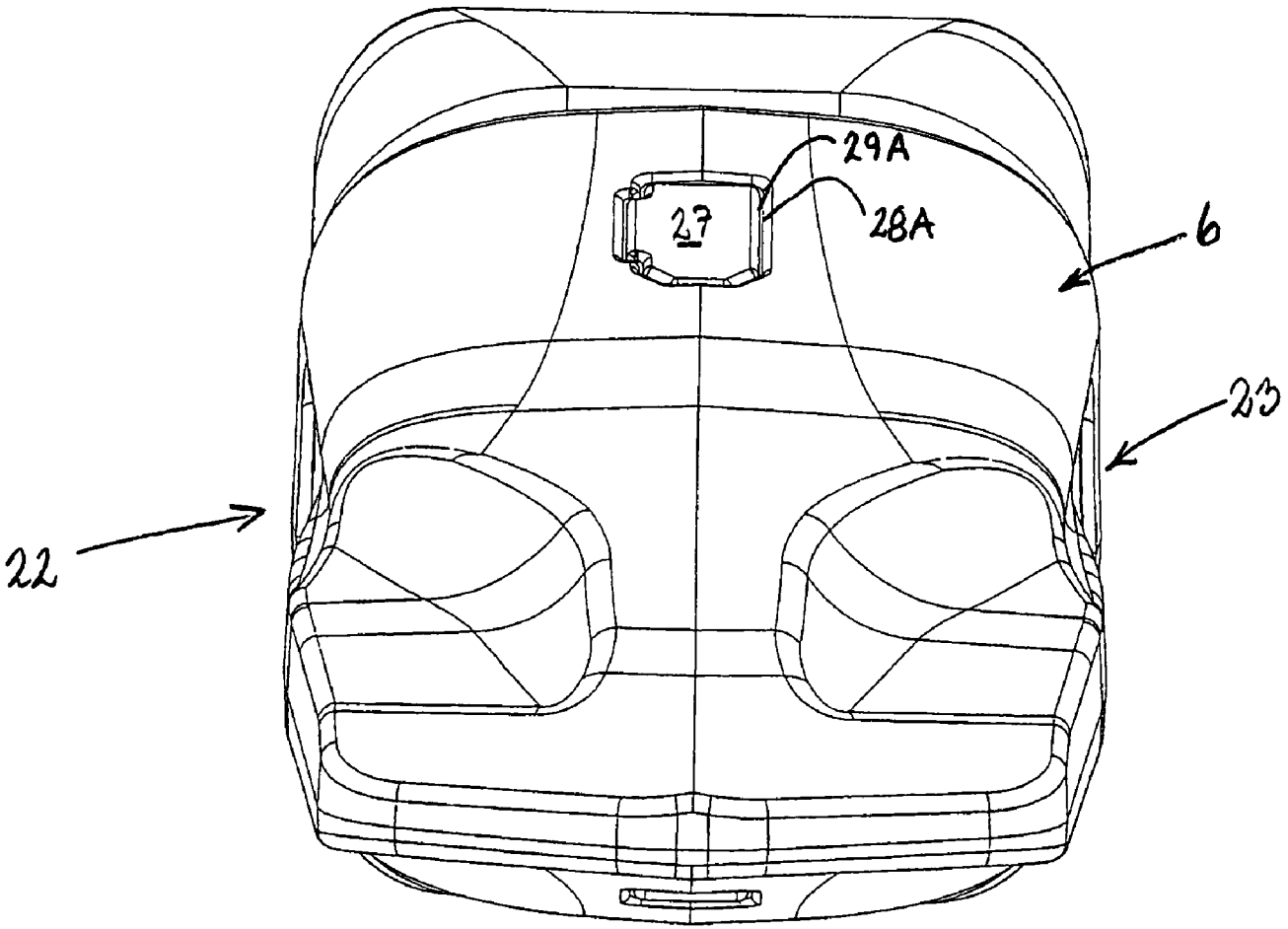

FIG. 10 is a schematic front view of parts of the assembled coupling parts according to FIG. 1, viewed from the front.

Figure 11:
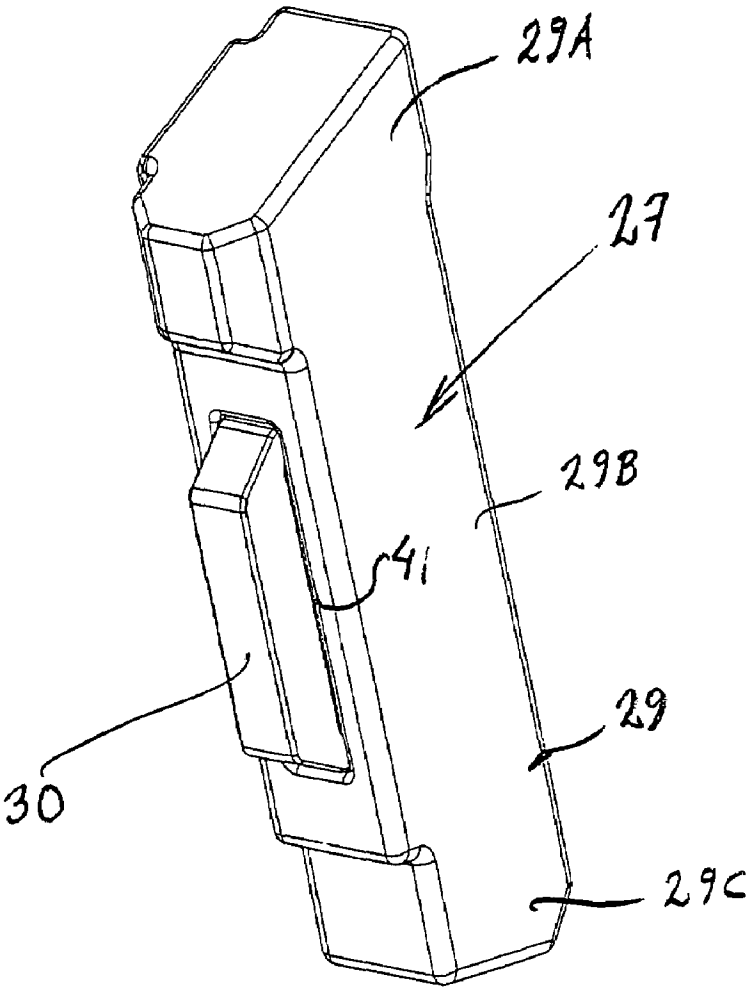

FIG. 11 is a schematic perspective view of parts of the locking device shown in FIG. 1, viewed from the front and obliquely from above, which view clearly shows the compression plate of the locking device and that the locking device is extremely asymmetrical in both the Y and the Z-direction.

Figure 12:
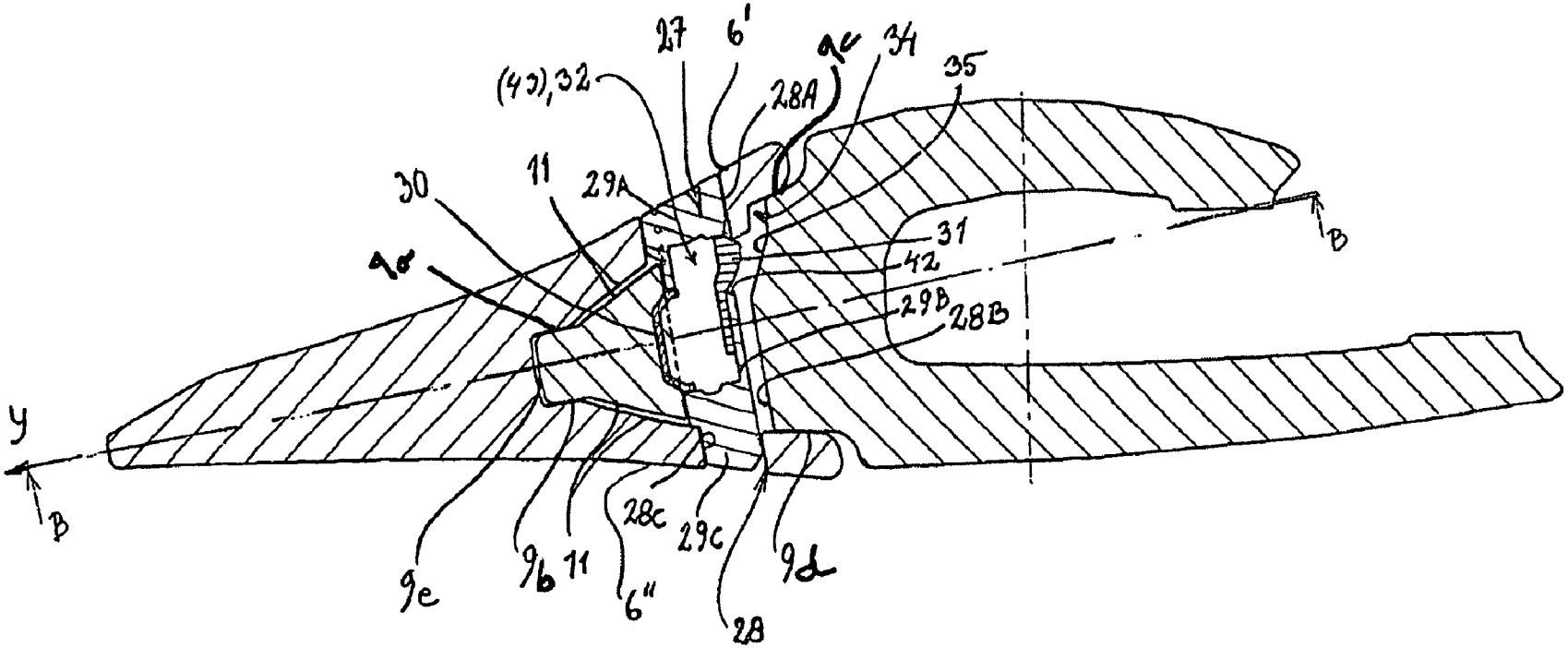

FIG. 12 shows a schematic vertical longitudinal section through parts of the assembled coupling parts according to FIG. 7.

Figure 13:
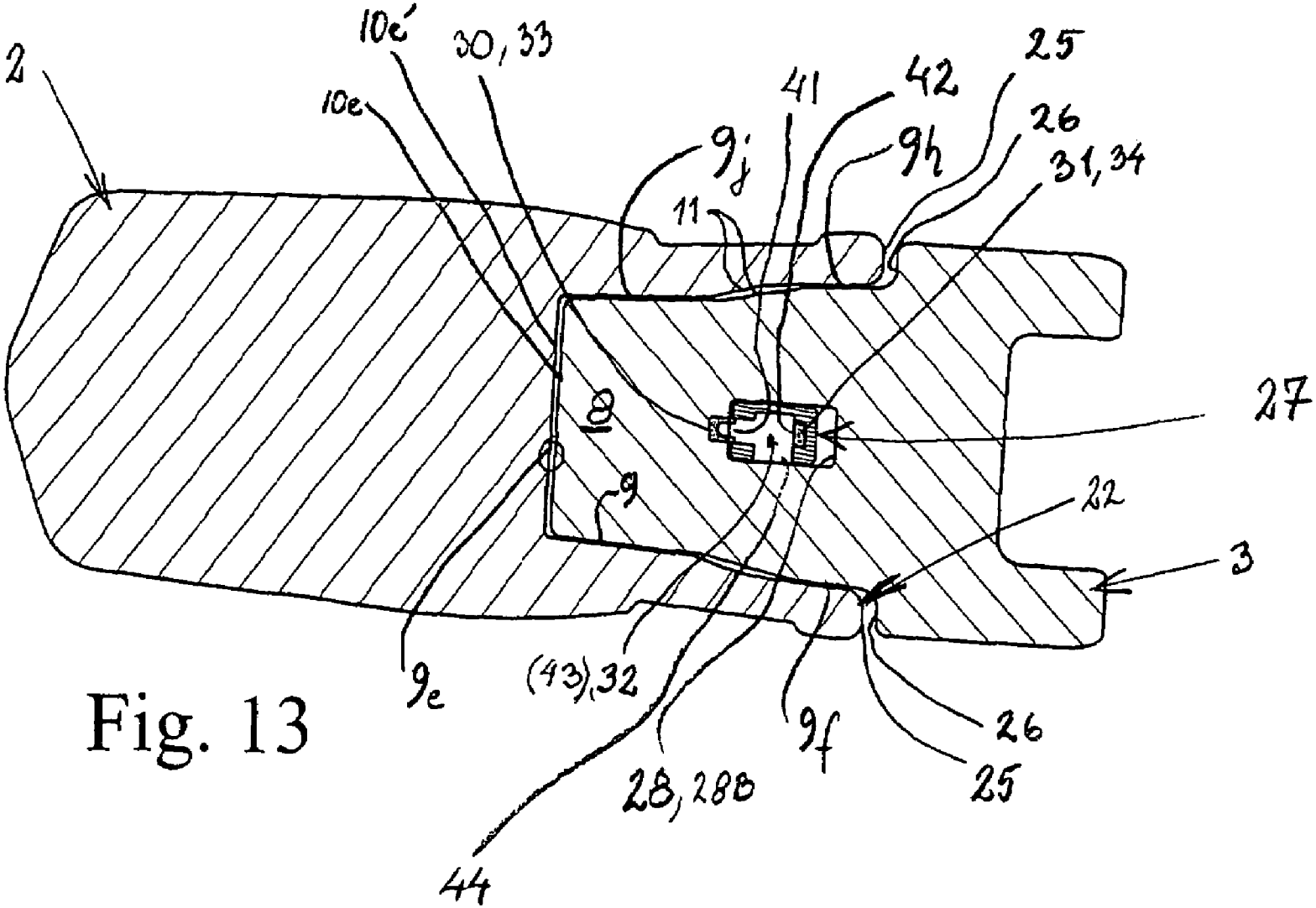

FIG. 13 shows a schematic horizontal longitudinal section, viewed from below, through parts of the assembled coupling parts according to FIG. 7, clearly showing a cross section through the locking device introduced into the locking device opening, which cross section shows the collateral gap opening in the locking device body intended for the expansion of a locking element in the form of an elastomer, the compression plate and a securing plate disposed on the front and rear side respectively of the lock body.

FIGS. 14:1-4 show schematically a wearing progression from a just assembled tine to a tine which is so worn down that the side joints have begun to be used. Certain parts of the wearing part are cut away in order better to illustrate the wearing progression.

FIGS. 15: *a*-*d* show schematic cross sections through parts of the assembled coupling parts according to FIG. 7, viewed from the rear.

Figure 16:
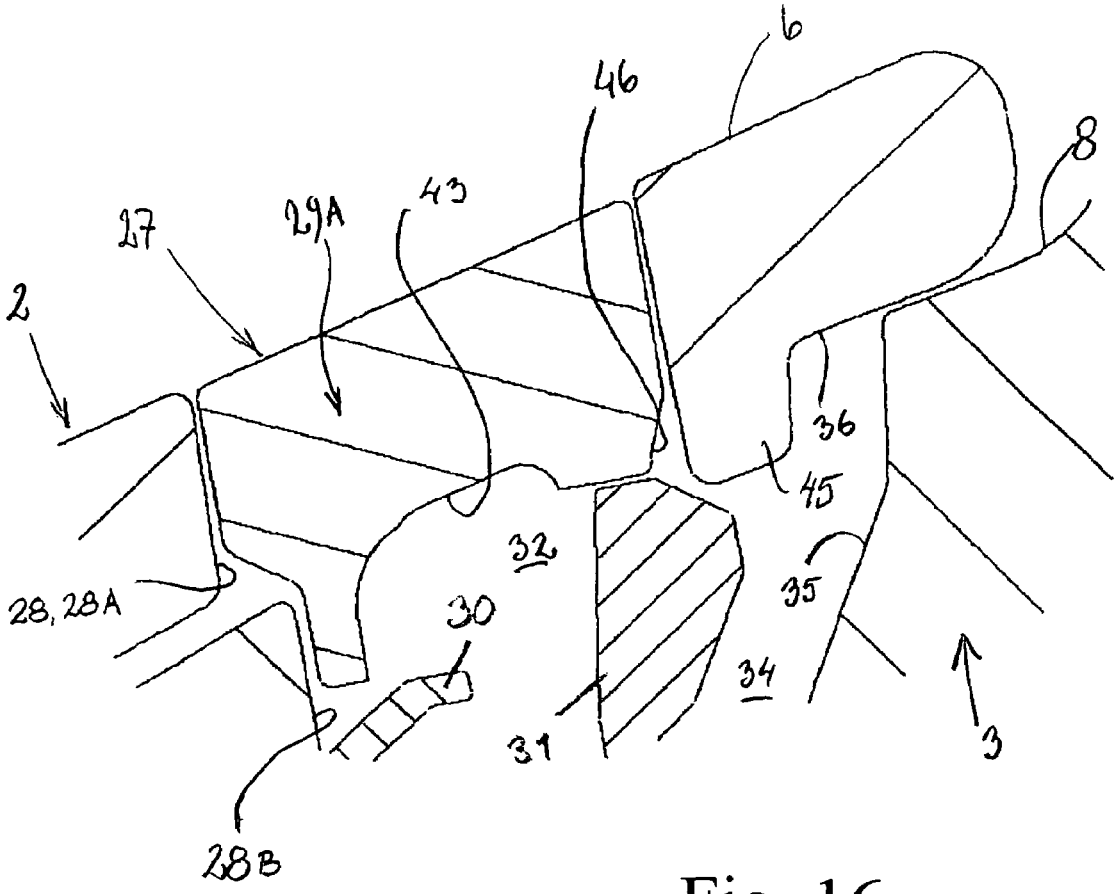

FIG. 16 shows an enlarged detail of the locking mechanism, comprising an upper part of the locking device and the upper locking device opening through the collar of the wearing part.

DETAILED DESCRIPTION OF EMBODIMENTS

With reference to FIG. 1, parts of a wearing parts system 1 according to a preferred embodiment of the present invention are shown schematically, which wearing parts system 1 is intended for a detachable fitting of exchangeable wearing and/or replacement parts 2 to the tool of a cultivating machine, here, more particularly, tines on the bucket of a machine (not shown in detail).

The invention which is described in greater detail below relates primarily, of course, to parts which are intended to be consumed, i.e. become worn, but any exchangeable working parts which have different functions in connection with the use of the particular tool also lie within the inventive concept. Below, the invention will only be described in detail, however, for an embodiment which comprises tines.

The wearing parts system 1 is shown in FIG. 1 together with a system of coordinates comprising three coordinate axes X, Y, Z for illustrating the mutual positions and extent relative to one another of the below-specified forces, parts and details. The force components $F_x$, $F_y$ and $F_z$ to which an acting load (F) gives rise according to the shown system of coordinates have been given a more detailed description above.

The wearing parts system 1 comprises two main, mutually interacting coupling parts 2, 3. On the one hand, the front wearing part 2 in the form an exchangeable tine point and, on the other hand, a rear stationary holder part 3 for permanent fastening to the particular tool (not shown in detail).

In order to achieve a dynamic, yet still reliable securement of the exchangeable tine point 2 to the holder 3, the wearing parts system 1 also comprises a removable coupling system 4 common to the said coupling parts 2, 3, which system is also referred to as a hood system, having a characteristic coupling geometry 4 and a detachable locking mechanism 5. The line of symmetry of the coupling geometry 4.in the Y-direction, along or parallel with which all axial forces, $F_y$, are thought to act, is best shown in FIG. 1 and FIGS. 5-9.

Figure 2:
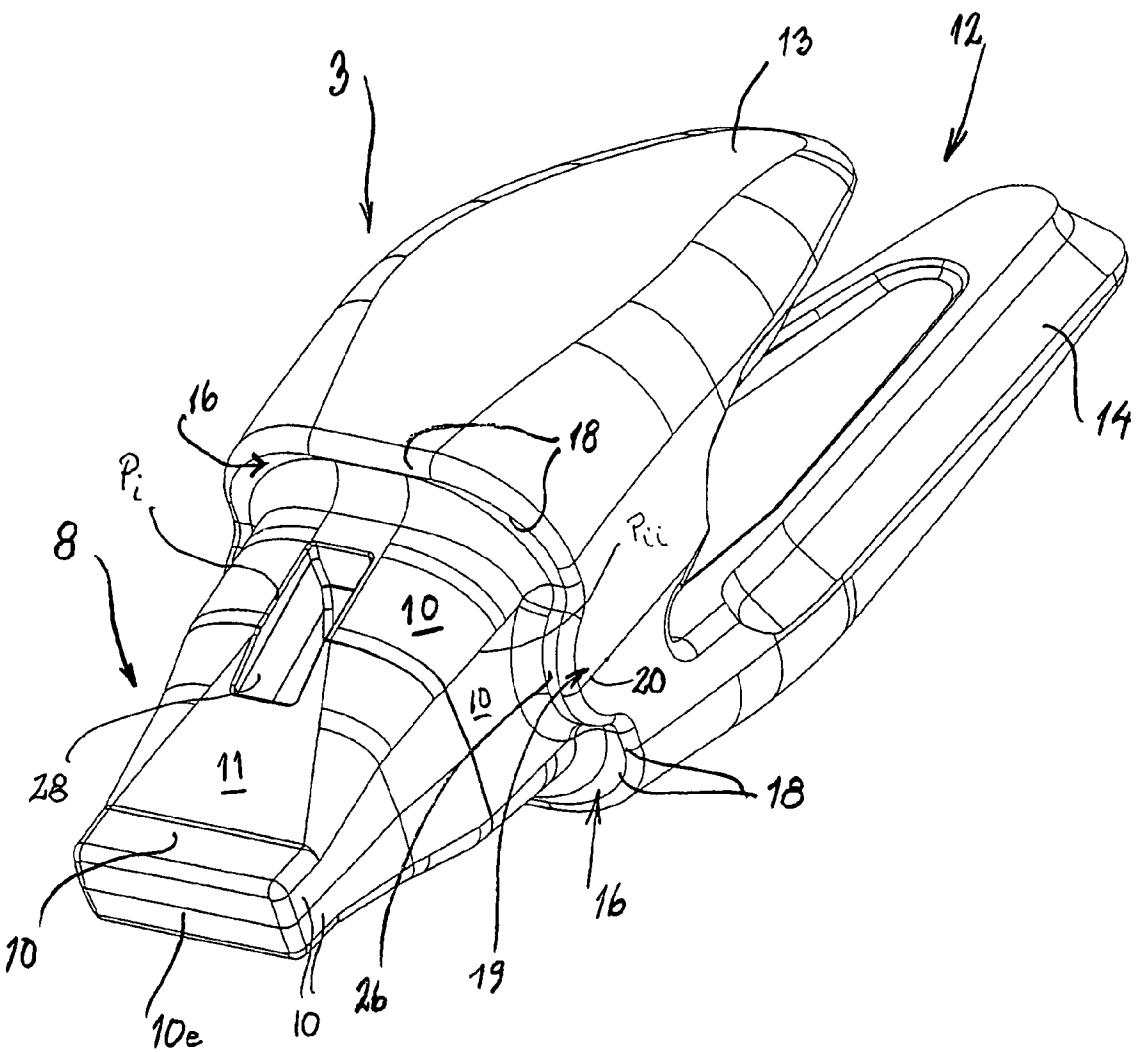
FIG. 2 is a schematic perspective view of parts of the holder part according to FIG. 1, viewed from above and obliquely from the front.
Figure 3:
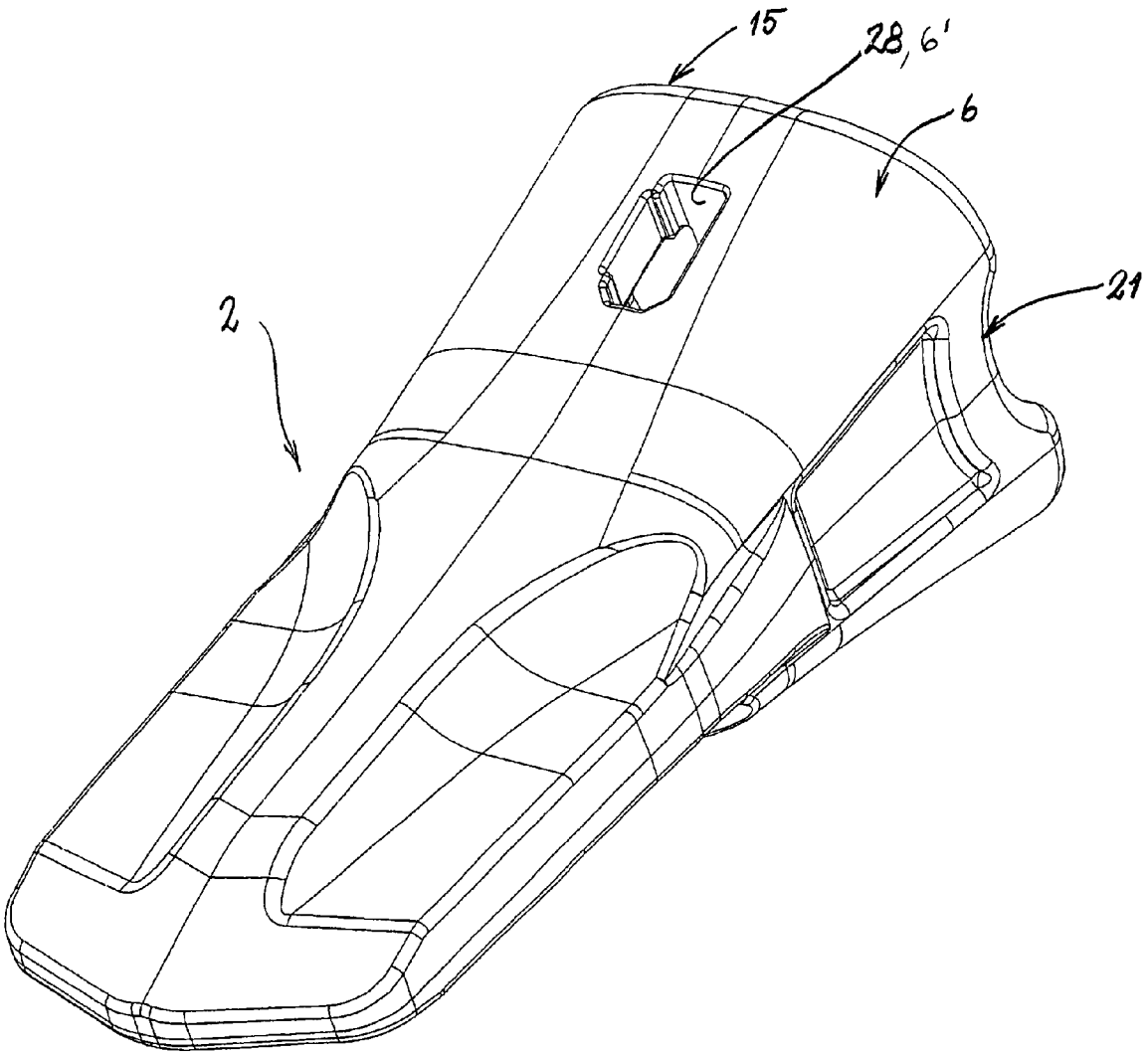
FIG. 3 is a schematic perspective view of parts of the wearing part according to FIG. 1, viewed from above and obliquely from the front.

The first, front coupling part 2, see expediently FIG. 3, comprises a rear segment 6 comprising a sizeable hollow 7, see especially FIG. 4*a*, which hollow is intended substantially to enclose like a hood 6, around all its outer sides, a front end part 8 of the opposite, second coupling part 3, which front end part is tapered forward in the Y-direction, i.e. is wedge-shaped or beak-shaped, see FIG. 2.

The hood 6 and the beak 8 comprise a plurality of specially configured surface zones 9, which interact with one another directly or after a certain amount of wear, see especially FIGS. 12, 13, 14 and 15. Each such surface zone 9 comprises at least two mutually opposite and interacting contact faces 10 or non-contacting surfaces 11, see FIGS. 2 and 4, at least one of which is disposed on the first coupling part 2, whilst the other is disposed on the second coupling part 3.

The contact faces 10, which, for example, can have an essentially flat, concave or convex shape, etc., depending on their position, comprise guide, sliding, friction or stop faces 10, which are arranged with different inclinations, extents and positions relative to one another and to the system of coordinates in order to create the coupling geometry 4 characteristic of the invention. The contact faces 10 are herein designed to bear, or come to bear, one against the other in mutual interaction, either directly after the fitting of the coupling parts 2, 3 or after a certain defined wearing down of certain of the surfaces 10. The specific properties and positions of certain of the said surface zones 9 and contact faces 10 will be described in greater detail below.

In the embodiment shown here, the rear part 12 of the holder 3, see FIG. 2, comprises two opposite engagement legs 13, 14 projecting rearward from the beak 8, which engagement legs are intended to be fixed essentially permanently, by fastening joint, to the particular tool, for example by a weld joint or bolted joint (not shown)—in the example shown in the figures, by weld joint on either side of the active front edge of a tool (not shown).

The free outer circumferential segment 15 of the hood 6, see FIGS. 4*a*-4*b*, hereinafter referred to as the tine collar 15, is corresponded to by a segment 16 opposite the tine collar 15 and interacting therewith, which latter segment, hereinafter referred to as the beak collar 16, is disposed on the holder 3, see FIG. 2. Each collar 15, 16 comprises an essentially vertically arranged edge or end face 17, 18, which end faces 17, 18 are mutually opposite.

The two coupling geometries 4, comprising the changing guide, sliding, friction or stop faces 10, and certain non-contacting surfaces 11, which at least initially are free from contact with the tine part 2, which surfaces 10, 11 interact to produce the said removable coupling system 4, are disposed, on the one hand, on the outer side of the beak 8 of the rear coupling part 3 and along the end face 18 of the beak collar 16, to create the external coupling geometry 4 of this coupling part 3 and, on the other hand, inside the front coupling part 2 on the inner side of the hood 6, and along the end face 17 of the tine collar 15, to create the internal coupling geometry 4.

Side Radius, Secondary Stop Face:

From that end face 18 of the beak collar 16 which faces toward the wearing part 2, i.e. its front edge, on both sides of holder part 3, i.e. the sides which in FIG. 2 are shown as arranged essentially parallel with the vertical longitudinal plane of symmetry (XY) according to the above-defined system of coordinates, a side-vertical projection 19 of a certain defined radius 20 is arranged protruding in the direction of the tine part 2.

The two projections 19 are corresponded to by two recesses 21 disposed directly opposite these and made in the end face 17 of the tine collar 15, i.e. its rear edge (see expediently FIGS. 4*a*-4*b*), on either side of the outer periphery of the hood 6. Either the recesses 21 are designed to interact with the projections 19, directly after the coupling parts 2, 3 have been coupled together to produce two collateral rotary joints 22, 23, or the recesses 21 and the projections 19 are arranged at a small distance apart via a play 24, see especially FIG. 14:1, whereby the said interaction occurs only after a certain defined wearing of certain defined contact faces 10 has taken place, preferably then also in a certain mutual order of wear for the contact faces 10 in question.

The schematic side view of the assembled coupling parts 2, 3 according to FIG. 14:1 shows this initial play 24 between the collars 15, 16 of the wearing part and holder part 2, 3 respectively, and a preferred position for one of the two common side joints 22 disposed on each side of the coupling parts 2, 3 and between the collars 15, 16, which side joints comprise two end faces 25, 26 disposed directly opposite each other and arranged essentially radially about the Z-axis, see FIG. 4*b* and FIG. 2, and having mutually different radii $R_1$, $R_2$, see FIG. 14:1.

The radius $R_1$ for the respective recess 21 is preferably somewhat larger than the radius $R_2$ for corresponding projections 19, which has the effect that the clearance, i.e. the play 24, varies depending on the radii which are chosen and that the contact between these curved end faces 25, 26 will be made, primarily, at the common centre of the different radii $R_1$, $R_2$ in the horizontal plane (YZ), i.e. at that point $M_0$ of the projections 19 which juts out most from the end face 18 of the beak collar 16, see FIG. 14:2, so as then, after certain defined wear, to grow symmetrically into a radial contact zone 22', 23' about this mid contact point, which therefore constitutes essentially a torque origin $M_0$ as the wear progresses.

The essentially predetermined radial contact zones, common to the coupling parts 2, 3, between the mutually facing end faces 25, 26 of the respective collars 15, 16, i.e. the joints 22, 23 thus created on each side of the coupling parts 2, 3 and about whose mid contact points $M_0$ and along whose contact zones, respectively, the tine part 2 and the holder part 3 are designed to interact dynamically, with accompanying transmission of loads, result in the rest of the tine and holder collars 15, 16 normally being kept apart, since the play 24 therebetween is considerable. This prevents wear between the collars 15, 16 outside of the purpose-made contact zone 22, 23 between the said end faces 25, 26.

The present construction prevents or at least minimizes the risk of unfavourable secondary contact zones and, hence, possible disadvantageous leverage ratios being able to occur anywhere else along the vertical end faces 17, 18 between tine part 2 and holder part 3. The possible occurrence of the above-described problem with disadvantageous shearing forces is also thereby averted.

Locking Mechanism:

The locking mechanism 5 comprises a locking device 27, see FIG. 11, and a locking device opening 28, which runs transversely to the longitudinal direction Y of the wearing parts system 1 and essentially vertically through both the beak 8 and the two mutually opposite upper 6' and lower walls 6" of the hood 6 and in which the locking device 27 is intended to be introduced, see FIG. 2 and FIGS. 3 and 4, plus FIG. 12

Three-Section Locking Mechanism:

The body 29 of the locking device 27 and the locking device opening 28 comprises a plurality of different-sized but mutually parallel cross-sectional sections, see FIGS. 11 and 12, which, for the locking device body 29, are arranged with the smallest section 29C downward and the largest 29A uppermost in the direction of introduction of the locking device 27, which then also applies to the cross section of the locking device opening 28 through the upper 6' and lower hood walls 6" of the tine part 2, i.e. that the upper opening 28A is larger than the lower opening 28C.

The locking device body 29 and the locking device opening 28 are designed such that the cross sections for the locking device openings 28A and 28C through the hood 6 of the tine part 2 and the cross sections 29A and 29C for the locking device body 29, where the positions of the sections correspond, are the same apart from necessary tolerances, i.e. these cross-sectional segments fit well together. The rigid locking device body 29, made preferably of steel, acts as a mechanical spacer, thereby preventing the tine part 2 from being pulled/falling from the holder part 3.

The locking device 27 comprises, over and above the locking device body 29, a number of movable engagement parts 30, 31, see FIGS. 11 and 12, which are designed to act via continuous gap openings 41, 42 in the locking device body 29, which gap openings are described in greater detail below, and an elastic element 32 (see FIGS. 12 and 13) arranged in a hollow 43 inside the lock body 29 having a further continuous gap opening 44 for the expansion of the elastomer 32 upon compression, described in greater detail below. The elastic element 32 is intended to generate the elastic force which acts against the engagement parts 30, 31, whereby these are pressed outward toward their outer, extended position. In the shown embodiment, the engagement parts 30, 31 are constituted by two metallic, essentially vertically arranged plates 30, 31, which plates 30, 31 are comprised, on the one hand, by a front compression plate 30 and a rear securing plate 31. These plates 31, 32 are fastened to the elastic element 32 in a suitable manner or the plates 31, 32 comprise devices or cross sections which prevent the plates 31, 32 from being able to fall out through the said openings 41, 42, see FIG. 12.

FIG. 13 shows a cross section from below in the horizontal plane (YZ) through the locking device 27 and the locking device opening 28, i.e. essentially level with the middle of the compression plate 30. On the front side of the locking device opening 28B through the beak 8 there is a, in the shown embodiment, front cavity 33, intended to receive the compression plate 30. The locking device opening 28B through the beak 8 also comprises a rear cavity 34, see FIG. 12, along the whole of the rear side of the locking device 27, i.e. the cross section 28B of the locking device opening 28 through the beak 8 is larger in the Y-direction than is the corresponding cross section 29B of the locking device body 29. A rearward sloping angular bevel 35 is made on the rear side of the said locking device opening 28B through the beak 8, whereby the cross-sectional width of the opening 28B in the Y-direction steadily increases in the direction upward toward the hood roof 36, i.e. the upper inner side of the hood 6, see FIG. 16. This upper part 35 of the rear cavity 34 is intended for the securing plate 31. A measure, also including the compression plate 30 fully extended by the elastic element 32, is expediently somewhat less than the measure 29A, whereby the elastic element 32 produces a certain pretensioning which is designed to hold the tine part 2 in a position pushed up onto the holder part 3, at the same time as it prevents the locking device 27 from falling out of its position in the locking device opening 28. On the other hand, the cross section 28B of the locking device opening 28 through the beak 8 might be larger than the two openings 28A, 28C through the hood 6, the main point being that a rear, empty space is created so that no contact exists in the portion between the locking device body 29 and the locking device opening 28B through the beak 8. The possibility of wear in this portion is thereby eliminated.

Further, as a result of the different-sized and successively expanding sections 29A, B and C for the locking device 27, and 28A and 28C for the locking device opening 28, the abovementioned, sought-after advantages are achieved that the locking device 27 can be introduced to about half its length before it comes round to the larger sections or the projecting plates 30, 31, necessitating a hammer, and that the locking device 27 does not need to be manually held during the last driving-down part of the introduction.

A further advantage which is achieved is that the elastic element 32 does not need to be compressed to a significantly higher degree during the actual fitting and removal of the same than compared with the compression which the elastic element 32 has when the wearing parts system 1 is ready for operation, since the uppermost largest cross section 28A of the locking device opening 28 is configured a shade larger than the largest cross section through one or other plate 30, 31 in the active locking position of the locking device. Further, the elastic element 32 does not need to be overcompressed in order to obtain a sufficiently large pretensioning distance and the whole of the motional path of the elastic element 32 in the operative position can be utilized. The fact that the plates 30, 31 of the locking device do not significantly rub against the wall of the locking device opening 28A through the hood 6 in the course of fitting/removal, and against the wall of the locking device opening 28B through the beak 8 during operation, means that the plates 30, 31 and the walls 28B run a low risk of being worn down. The main reason why the plates 30, 31 of the locking device do not significantly rub against the wall of the locking device opening 28B during operation is the fact that the locking device 27 relatively freely accompanies the wearing and/or replacement part 2 in its motions relative to the holder part 3 in the Y-direction, thanks to the rear cavity 34. The motions are instead limited by the contact zones 9 of the wearing parts system 1. In order, for example, to facilitate the removal of the locking device 27, it is therefore conceivable to omit the cavity 33 and have the compression plate 30 act directly against the wall of the opening 28B, see dashed line in FIG. 12, since essentially no axial forces $F_y$ caused by the actual operation have to be absorbed by means of the locking device 27. The main function of the locking device 27 is, as previously mentioned, to hold the tine part 2 in pushed-up position on the holder part 3, at the same time as, via the securing plate 31, it shall prevent the locking device 27 from falling out of its position in the locking device opening 28.

Figures 15A, 15B, 15C, 15D:
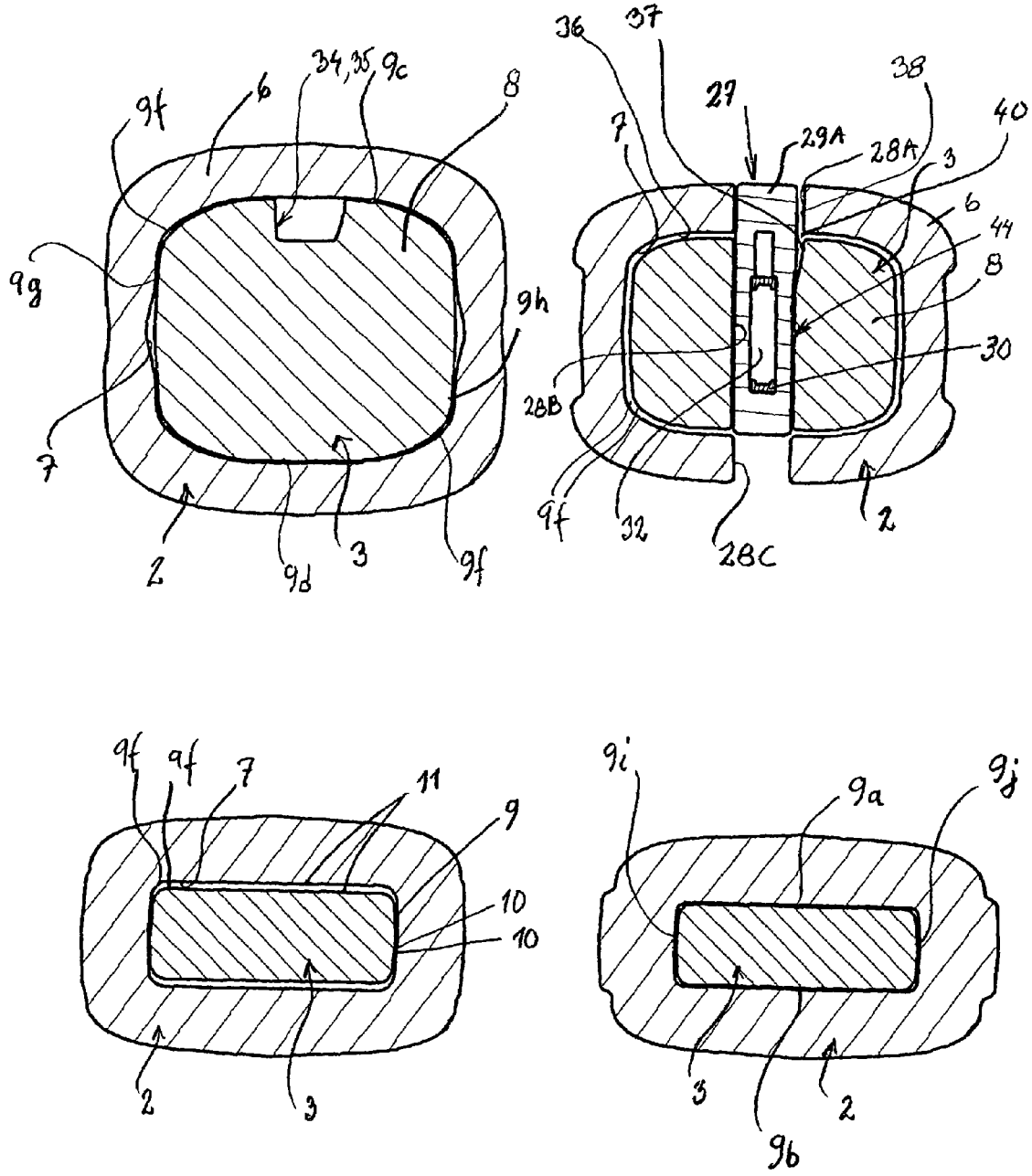

Notch for Locking Mechanism:

The locking device opening 28B through the beak 8 also comprises a second angular bevel 37, which is made on one side of the said part 28B of the locking device opening 28, and as a result of which angular bevel 37 the cross-sectional width of the opening 28B in the Z-direction steadily increases in the direction upward toward the bottom side of the hood roof 36, see FIG. 15*b*. The upper locking device opening 28A through the hood 6 also comprises the one collateral, yet essentially vertical extra bevel 38, which bevel 38 constitutes a continuation of the said collateral angular bevel 37 of the locking device opening 28B.

Correspondingly, the locking device 27 comprises an increase in cross-section in the Z-direction in the form of an upper, collateral vertical shoulder 39, see FIG. 1, which shoulder 39, with the exception of necessary tolerances, has the same shape as the said collateral, vertical bevel 38. (Note that the section in FIG. 15*b* is chosen such that the lower part 29C of the locking device 27 and the shoulder 39 are not shown). On the other hand, the locking device 27 can preferably be without a shoulder corresponding to the collateral angular bevel 37 of the locking device opening 28B in the Z-direction, such that an empty space 40, see FIG. 15*b*, exists from the inner side of the hood roof 36 down to essentially the top edge of the abovementioned gap opening 44 made in the one side of the locking device body 29, which gap opening 44 is intended for the expansion of the elastomer 32 upon the compression of the elastomer 32 in connection with the removal of the locking device 27. It will be appreciated, however, that even with a further shoulder of this kind, the functioning which is described in greater detail below, as well as the result, will be essentially the same.

The locking device 27 and the locking device opening 28 are therefore designed such that the cross sections for the locking device openings 28A, 28C through the hood 6 of the tine part and the cross sections for the lock body 29A, 29C, where the positions of the sections correspond, are the same apart from necessary tolerances, i.e. these segments fit well together, see FIGS. 8-10 and 12. The penetration of dirt is therefore made considerably more difficult, but is still not wholly eliminated because of the said tolerances, with the result that empty space 40 along one side of the locking device 27, created by the angular bevel 37 of the locking device opening 28B, is at risk of being filled with dirt.

The present invention has solved this dirt problem by virtue of the fact that, when the locking device 27 is removed, whereupon it is driven a certain distance upward in the X-direction whilst the compression of the rubber 32 through the pressing-in of the plates 30, 31 causes the elastomer 32 to expand asymmetrically sideways out in the only direction allowed by the gap opening 44, the empty space 40 will be constantly shifted in the upward direction thanks to the difference in size in the Z-direction between the various cross sections 29A, and 29B and 29C respectively, of the locking device 27 and the corresponding cross sections of the locking device opening 28. The effect of this is that the expanding part of the elastomer 32, provoked by the pressing-in of the plates 30, 31, is always able to move out into the empty space 40 which is thereby constantly created in the upward direction. Should the locking device 27 also comprise the abovementioned additional shoulder corresponding to this initially empty space 40, the empty space 40 will still be created as the locking device 27 is pushed upward out of the locking device opening 28. The removal of the locking device 27 is therefore essentially independent of all dirt penetration.

The Pin and the Shearing Zone Relocation:

Connecting to the upper, larger locking device opening 28A through the hood 6 of the tine part 2 there is a downward-projecting, transverse pin 45, see FIG. 16, disposed on the inner side of the hood roof 36, against which the rear securing plate 31 of the locking device 27 shall fix. This gives the advantage of enabling the securing plate 31 to be moved downward, so that the openings 35, 42 through and in which the plate 31 operates are thus shifted out of the direct shearing zone between the tine part 2 and the holder part 3, which shearing zone has additionally been shifted somewhat upward as a result of the locking device body 29 and the pin 45 being free from mutual contact by virtue of a downward widening bevel 46, which has been made on the rear side of the locking device body 29, facing toward the said pin 45. A further advantage, and actually of greater importance, is that when the securing plate 31 is moved downward, the hollow 43 for the elastomer 32 can also be moved downward, whereby the shearing loads will be absorbed along a virtually homogeneous cross section through the solid body 29 of the locking device 27. In order further to increase the strength of the locking device 27, the opening 44 in the lock body 29 for the expansion of the elastomer 32 is made only on the one side face of the lock body, see FIG. 13.

The Surface Zones of the Coupling System:

Each load (F) which acts against the tine is absorbed by the coupling geometry 4 via the abovementioned, specially configured and mutually interacting surface zones 9, comprising the mutually opposite and initially interacting contact faces 10 disposed in or on the holder part 3, and the other contact faces 10 in or on the wearing part 2, which interact with said holder part, but also certain of the surfaces 11 which are non-contacting at the start of the operation and which, after a certain wear, come into contact with one another.

A vertical force $F_x$, applied to the tine point 2, will be absorbed by the coupling geometry 4, on the one hand via one of two front flat horizontal contact zones 9*a*, 9*b* (see FIGS. 12 and 15*d*), determined by the side of the tine from which the force $F_x$ acts and, on the other hand, at the rear edge and, viewed in the horizontal plane of symmetry YZ, on the opposite side of the said front horizontal contact zone 9*a* or 9*b*, via two rear contact zones 9*c* and 9*d*, which are symmetrical in relation to the locking device opening 28 and the longitudinal symmetry axis Y and are angled to the horizontal plane of symmetry YZ, see FIGS. 12 and 15*a*, the essentially horizontal marginal lines of which zones 9*c*, 9*d*, if cross sections are imagined through the wearing and holder part 2, 3 respectively, constitute the portions between the rounded corners 9*f* of the, in this case, essentially "rectangular-elliptical" cross sections, see FIGS. 15*a*-15*d*. The rear contact zones 9*c*, 9*d* pass into a respective peripheral side edge zone 9*g*, 9*h*, which is parallel with the side edge zones 9*i*, 9*j* of the front contact zones, see FIGS. 13, 15*a* and 15*d*, which can be parallel with the Y-line of symmetry but which preferably have a slight angle thereto.

In the same way, a side force $F_z$ applied to the tine point 2 is absorbed by one of the pairs of front flat side edge zones 9*i*, 9*j* in the coupling geometry 4 and at the rear edge, on the opposite side of the particular pair of the said front side edge zones 9*i*, 9*j* viewed in the vertical plane of symmetry XZ, by, in relation to the longitudinal symmetry axis Y, the two symmetrical rear, essentially vertical pairs of side edge zones 9*g*, 9*h*, the peripheral line of which side edge zones 9*g*, 9*h*, 9*i*, 9*j*, if cross sections are imagined through the wearing and holder part 2, 3 respectively, constitutes the vertical edges of the herein essentially "rectangular-elliptical" cross sections.

The axial force $F_y$ is absorbed, see FIG. 13, in the abovementioned manner via one or more contact zones 9*e*, 22, 23, each consisting of at least two opposite and mutually interacting contact faces 10*e*, 10*e*', 25, 26, which expediently are placed substantially perpendicular to the said longitudinal line of symmetry Y and with a radius $R_1$, $R_2$ or inclination of such magnitude that the functioning is essentially the same, i.e. functioning akin to the abovementioned outer and inner stop faces disposed or acting essentially in the cross-vertical plane (XZ), and in which the one contact face 10*e*, 26 is disposed on the holder part 3 and the other 10*e*', 25 on the wearing part 2. After more extensive wear, the particular originally non-contacting surfaces 11 and highly inclined surfaces acting as sliding zones between the tine part 2 and the holder part 3, i.e. those surfaces which have or acquire a certain wedging effect, can also, however, absorb a certain part of the load. The ideal is, however, that the substantially perpendicular contact zone 9*e* and the radial contact zones 22, 23 by the vertical front edge 10*e* of the beak 8 against the likewise vertical inner side 10*e*' of the wearing part 2, see FIG. 4*b*, and the end faces 25, arranged radially about the Z-axis, on the recess 21 of the wearing part 2, and the end faces 26, arranged radially about the Z-axis, on the projections 19 of the holder part 3 absorb essentially all the axial load $F_y$ and hence essentially all the wear.

As the wear increases on the original vertical 10*e*, 10*e*' and "radially vertical" stop faces 25, 26 designed for wear, the inevitable secondary contact zone 22', ee FIG. 14:4, will be formed and will gradually grow, but now only after a certain predefined, greater wear and longer period of use and then, after all, for the very most part, or only slightly, at the inner stop zone 9*e*, at the two collateral rotary joints 22, 23 and at the more inclined contact zones 9, and not, as previously, for the most part uncontrolledly and at very disadvantageous positions with regard to changing leverage ratios, between the rear edge 17 of the tine collar 15 of the wearing part 2 and the front edge 18 of the collar 16 of the holder 3.

The front, paired vertical side and horizontal contact zones 9*i*, 9*j* and 9*a*, 9*b* respectively have an extent virtually parallel with the Y-line of symmetry running through the nose 8 of the holder 3. Each common, longitudinal "rounded edge" 9*f* between two adjacent, front side and horizontal contact zones 9*i*, 9*j* and 9*a*, 9*b* respectively and an intermediate peripheral line is arranged parallel with a corresponding edge and peripheral line for each imaginary cross section of the said rear, paired vertical side and horizontal contact zones 9*g*, 9*h* and 9*c*, 9*d* respectively, see FIGS. 1, 13 and 15. The aforementioned tendency of the tine 2 to slide down from the holder nose 8 is thereby effectively combated, through imitation of the so-called drawer effect, i.e. the particular contact faces 10 between the holder part 3 and the tine part 2 will jam and thereby lock the parts 2, 3 together. The torque loads to which the component forces $F_x$, $F_y$ and $F_z$ give rise are primarily absorbed via one of the front and one of the rear contact zones 9 on either side of the axis about which the rotation takes place according to the above-described. During operation, the integral contact faces 10, primarily the stop faces 10*e*, 10*e*', 25, 26, will therefore, during irregular dynamic motion between wearing part 2, holder part 3 and locking device 27, become sheared, worn and deformed, but the tine part 2 will grow substantially much more worn because of the outer wear, with the result that, over a long period, only this part 2 has to be exchanged before a replacement of the holder part 3 is also called for. This means that material costs and down times are, very advantageously, heavily reduced.

Since the projections 19 and the recesses 21 according to the invention at least initially eliminate the undesirable leverage ratios and asymmetrical wear which were previously so troublesome, the shearing forces which will powerfully cut off the locking device 27 when the wearing parts system 1 is exposed to rotary loads are minimized, since the contact between the collars of the system, over a long period, only occurs at the position designed for this purpose, i.e. the origin $M_0$.

The positions of the secondary stop zones, in combination with the locking device 27, do not therefore replace the intended front and rear horizontal and collateral contact faces 10. A torque leverage which is highly beneficial to strength will always be obtained for all conceivable load cases, which leverage will not give rise to any shearing forces which are serious for the construction. Moreover, those shearing forces which are still generated in the sliding zone between the holder part 3 and the wearing part 2 will act in an almost unbroken cross section through only the homogeneous part of the lock body 29A, 29C.

ALTERNATIVE EMBODIMENTS

The invention is not limited to the shown embodiment but can be varied in a variety of ways within the scope of the patent claims.

In the figures to the present patent application, for example, the front "coupling part" of the holder part 3 constitutes the said beak 8, which is enclosed by the rear "coupling part" of the tine part 2, which latter coupling part therefore constitutes the hood 6. It will be appreciated that the opposite relationship between hood and beak is, of course, conceivable. It falls within the inventive concept, therefore, to swap over the mutual position of the recesses 21 and projections 19, such that the projections are instead disposed on the collar 15 of the wearing part 2 and vice versa. In this case, the abovementioned exchange is, however, impaired.

Further, in the embodiment shown in the figures, the projections 19 are constituted by two essentially semi-circular extensions, projecting radially from the beak collar 16 in the direction of the wearing part 2, which projections 19 are corresponded to by essentially semi-circular depressions 21, made in the opposite contact face 25, in the hood 6 of the tine part 2. The realization of the recesses 21 and projections 19, instead of involving two interacting regular semi-circular radii $R_1$, $R_2$, should be able to be constituted by a realization having a somewhat more step-shaped "angular" concave or convex shape, as long as a certain rotatability about a centre axis essentially in the horizontal plane XY is maintained, i.e. with small leverage ratio.

The main point is that, regardless of wear, the resulting leverage ratio will be as favourable as possible to the functioning and actual locking, for example by virtue of the fact that the torque leverage is as short as possible, which means that the mid contact point, the origin $M_0$, between the contact zones 22, 23 of the said recesses 21 and projections 19 should lie essentially in the horizontal plane (YZ) and parallel with the side plane XY along the Y-line of symmetry, respectively.

It will further be appreciated that the number, size, inclination, placement, surface structure and shape of the surfaces 10, 11 forming part of the coupling geometry 4 is tailored to the characteristic(s) or requirement(s) which, at a given time, obtain for the wearing parts system 1 and the particular instrument or tool, with the result that all other configurations with regard to the surfaces 10, 11 fall within the inventive concept.

The invention claimed is:

1. A wearing parts system for a tool of an earth moving machine comprising:

a holder part, attached to the tool and comprising a holder beak;

a replacement part comprising a hollow, configured to grip the holder beak such that said holder beak is at least partially fitted, along a line of symmetry extending longitudinally through the holder beak, into said replacement part, and further configured to be fixed therein by means of a locking mechanism inserted through both the holder part and the replacement part substantially perpendicularly with respect to the line of symmetry, a plurality of mutually interacting pairs of contact elements, disposed on each of said holder part and said replacement part, substantially symmetrically offset from the line of symmetry, comprising:

at least one pair of front contact zones disposed at the distal end of the holder beak and substantially symmetrically disposed on either side of the line of symmetry, and at least one pair of rear contact zones configured to increasingly taper proximally with respect to the line of symmetry and disposed at the proximal end of the holder beak and substantially symmetrically disposed on either side of the line of symmetry; and at least two interacting joints comprising radial projections extending from the holder beak from each of said at least one pair of rear contact zones, and corresponding radial recesses disposed in the replacement part into each of said at least one pair of rear contact zones, wherein said at least one pair of contact zones further comprise a holder beak collar comprising an end face perpendicular with respect to the line of symmetry and configured to extend around the distal end of said holder beak between said radial projections, and wherein said at least one pair of rear contact zones further comprise a radial recess collar opposite said holder beak collar and comprising an end face perpendicular with respect to the line of symmetry and configured to extend around the proximal end of said holder part between said radial recesses;

further wherein said at least two interacting joints are configured to provide a common rotational axis between them substantially perpendicular to the direction of fitting of the locking device and substantially perpendicular to the insertion path of said locking mechanism into said holder part and the replacement part, wherein the recesses each comprise a recess end face, and the projections each comprise a projection end face, wherein each recess end face and projection end face are configured to interact so as to limit the pushing-on of the replacement part over the holder part and further configured to ensure that the contact area between each corresponding recess end face and projection end face is an initially small contact area at a common center of each of said radial projections, and as the wear has progressed to said recess end face about the common center, that the contact area between each corresponding recess end face and projection end face is increased to a larger contact area, while at the same time the distance between the end faces of the interacting joints at their common center is substantially less than the distance between the respective end faces of said holder beak collar and said radial recess collar such that there is play between the collars, and at least one locking device, comprising at least a first, a second and a third section wherein the first section is configured to have the widest cross section and the third section is configured to have the smallest cross section among the first, second and third sections, configured to be placed through interacting openings disposed within both the holder part and the replacement part, such that when the locking device is placed through the openings in the replacement part and the holder part, three longitudinal sections are defined in the openings, in which the first section is configured to have the widest cross section, whilst the third section of the locking device opening through which the locking device is lastly inserted is configured to have the smallest cross section, and wherein the locking device comprises at least two movable engagement parts loaded by elastic material, wherein the engagement parts are constituted by a securing plate for detachable blocking of the locking device in a predetermined locking position, and a compression plate configured to load via its elastic material the contact elements of the replacement part and of the holder part against each other.

2. Wearing parts system according to claim 1, wherein the locking device comprises a rigid locking device body having an elastic material inlaid into the locking device body, wherein the material is configured to load at least one movable engagement part toward a predetermined position.

3. Wearing parts system according to claim 1, wherein the locking device comprises a hollow for the elastic material, wherein the hollow has a first gap opening configured to allow an expansion of the elastic material when the elastic material is subjected to load during the removal of the locking device, and one or more further gap openings configured to project beyond the body of the locking device when the locking device is free from external loads.

4. Wearing parts system according to claim 1, wherein the locking device opening through the holder beak of the holder part comprises a first portion in the direction of fitting which is at least wider in a first direction than a corresponding second portion of the body of the fitted locking device, which portion of the locking device opening comprises a first segment and a second segment, wherein the first segment, which is wider than the corresponding locking device body in the first direction, comprises a cavity configured to secure plate in an extended position blocking the locking device, whilst the second segment comprises or is configured to form a space configured to allow an expansion of the elastically deformable resilient material when the second segment is subjected to load during the removal of the locking device.

5. Wearing parts system according to claim 1, further comprising a pin disposed on the inner side of the roof of the hood and configured to connect to the locking device opening through the hood of the tine part, and further configured to affix to the securing plate of the locking device.

6. Wearing parts system according to claim 5, wherein a bevel, configured to widen downward in the direction of fitting of the locking device, is disposed on that side of the locking device body facing toward the said pin, and configured such that the locking device body and the pin are free from contact with each other.

7. Wearing parts system according to claim 1, wherein a cross section through the body of the fitted locking device level with the inner side of the roof of the hood consists of a homogeneous, solid, unbroken cross section or a cross section which is unbroken to the extent of at least 50% or more.

8. Wearing parts system according to claim 1, wherein a leverage ratio from the line of symmetry to the common center between the hood of the tine part and the holder part is equal to zero or less than the radius of the one or more projections.

9. Wearing parts system according to claim 8, wherein the radius for respective one or more recesses are larger than the radius for corresponding one or more projections.

10. Wearing parts system according to claim 1, wherein the two rear contact zones are configured with a greater angle of inclination to the line of symmetry of an inner, longitudinal peripheral line along the locking device opening through the beak than of an outer, collateral longitudinal peripheral line.

11. Wearing parts system according to claim 1, wherein the various contact faces comprise a plurality of different inclinations, conicities and roundings, several being parallel but laterally offset.

12. Wearing parts system according to claim 1, wherein one or more torque loads caused by the rotation of the replacement part in relation to the holder part are configured to be absorbed directly or after a certain minor wear by at least one of the front contact zones in interaction with at least the rear contact zones on the interacting joints.

* * * * *